US005923295A

United States Patent [19]

Nakano et al.

[11] Patent Number: 5,923,295

[45] Date of Patent: Jul. 13, 1999

[54] CIRCULAR POLARIZATION MICROSTRIP LINE ANTENNA POWER SUPPLY AND RECEIVER LOADING THE MICROSTRIP LINE ANTENNA

[75] Inventors: Hisamatsu Nakano, Tokyo; Kazuo Kobayashi, Kanagawa, both of Japan

[73] Assignee: Mitsumi Electric Co., Ltd., Tokyo, Japan

[21] Appl. No.: 08/760,032

[22] Filed: Dec. 4, 1996

Related U.S. Application Data

[30] Foreign Application Priority Data

| | | | |
|---|---|---|---|
| Dec. 19, 1995 | [JP] | Japan | 7-330709 |
| Dec. 19, 1995 | [JP] | Japan | 7-330710 |
| Dec. 19, 1995 | [JP] | Japan | 7-330711 |

[51] Int. Cl.[6] ..... H01Q 1/38

[52] U.S. Cl. ..... 343/700 MS; 343/731

[58] Field of Search ..... 343/700 MS, 731, 343/771, 806; 333/246

[56] References Cited

U.S. PATENT DOCUMENTS

| | | | |
|---|---|---|---|
| 4,293,858 | 10/1981 | Hockham | 343/731 |
| 4,459,593 | 7/1984 | Hall et al. | 343/731 |
| 4,475,107 | 10/1984 | Makimoto et al. | 343/700 MS |
| 4,713,670 | 12/1987 | Makimoto et al. | 343/700 MS |
| 4,963,892 | 10/1990 | Matsuo et al. | 343/731 |
| 5,006,858 | 4/1991 | Shirosaka | 343/731 |
| 5,594,455 | 1/1997 | Hori et al. | 343/700 MS |

FOREIGN PATENT DOCUMENTS

| | | | |
|---|---|---|---|
| 59-221007 | 12/1984 | Japan | 343/700 MS |
| 61-24311 | 2/1986 | Japan | H01Q 21/00 |
| 62-118609 | 5/1987 | Japan | 343/700 MS |

*Primary Examiner*—Don Wong
*Assistant Examiner*—Tan Ho
*Attorney, Agent, or Firm*—Frohwitter

[57] ABSTRACT

A circular polarization microstrip line antenna transmits and receives right-handed and left-handed circularly polarized waves by one microstrip line antenna. A dielectric sheet 3 is laid on a metal base 4, and a flexible film 2 is laid on the dielectric sheet 3. Microstrip lines 5 are formed at the right and left sides of the surface of the flexible film 2. Rectangular waveguides 8 are arranged under the right and left ends of the metal base 4, a hole 9 is perforated at the upper surface of the rectangular waveguide 8, a hole 10 is perforated at the positoin opposed to the hole 9 of the metal base 4, and inverted L-shaped feeding pins 11 are inserted to the holes 9 and 10. The horizontal part 13 of the feeding pin 11 is interposed between the flexible film 2 and the dielectric sheet 3, and the horizontal part 13 is opposed to the right and left ends 5*a* of the microstrip line 5. Further, a probe 21 is arranged at the lower surface of the rectangular waveguide 8, and the right and left probes 21 are connected to a transmitter 16 or a receiver 17 by coaxial cables 18.

12 Claims, 21 Drawing Sheets

CIRCULAR POLARIZATION MICROSTRIP LINE ANTENNA POWER SUPPLY AND RECEIVER LOADING THE MICROSTRIP LINE ANTENNA

BACKGROUND OF THE INVENTION

1. Field of the Invention

The present invention relates to a circular polarization microstrip line antenna, a power supply and a receiver loading the microstrip line antenna and, particularly, to a circular polarization microstrip line antenna used to transmit and receive in a satellite broadcasting or a satellite communication, a power supply and a receiver loading the microstrip line antenna.

2. Description of the Prior Art

A microstrip line is patterned on the surface of a board in a microstrip line antenna, and an overall ground plane is formed on the rear surface of the board. The individual microstrip lines are bent in a predetermined periodic wave shape such as a square wave, and a plurality of the microstrip lines are aligned at a suitable interval to constitute an antenna array. A power supply is provided at one end of the microstrip line, and a matching load is provided at the other.

A coaxial cable is normally used at the power supply. A central conductor of the coaxial cable is inserted from below into a hole perforated along the edge of the board, and the end is soldered to one end of the microstrip line. This soldering is extremely complicated. As the number of the microstrip lines of the antenna array is increased, the soldered parts are increased to be inefficient. An insulating tube conductor of the coaxial cable is connected to the ground plane of the rear surface of the board.

When a transmission is executed by such a microstrip line antenna, a high-frequency current of a predetermined frequency band (e.g., 12 GHz) is supplied by the coaxial cable. The high-frequency current is periodically bent in its traveling direction by carrying along the microstrip line. A left-handed circularly polarized wave is radiated if the microstrip line is a left-handed circular polarization antenna or a right-handed circularly polarized wave is radiate if the microstrip line is a right-handed circular polarization antenna by the synergistic action of the time and spatial sine wave of the high-frequency current and the spatial shape of the microstrip line. If the microstrip line antenna is a vertical polarization antenna, a vertically polarized wave is radiated, or if the microstrip line antenna is a horizontal polarization antenna, a horizontally polarized wave is radiated.

Since the antenna can be used for both the transmission and the reception by the same configuration, the polarized wave having the same characteristics as the radiated polarized wave can be naturally received by the microstrip line antenna used for the transmission. That is, if the microstrip line antenna is a left-handed circular polarization antenna, a left-handed circularly polarized wave can be received, or if the microstrip line antenna is a right-handed circular polarization antenna, a right-handed circularly polarized wave can be received. If the microstrip line antenna is a vertical polarization antenna, a vertically polarized wave can be received, or if the microstrip line is a horizontal polarization antenna, a horizontally polarized wave can be received.

The received polarized wave having predetermined characteristics is input to a receiver via the coaxial cable. The receiver demodulates the input frequency energy via an amplifier, a filter and a mixer and outputs the demodulated wave.

In the circular polarization microstrip line antenna in which the periodic wave shape of the microstrip line antenna is a square wave shape, the lengths of the upper side, the lateral side and the bottom of the square wave shape have predetermined correlation with respect to the line wavelength g of a traveling wave propagated on the microstrip line. The "predetermined correlation" is not univocal for the line wavelength g, but various relational expressions have been heretofore proposed. The purpose of the proposal is to enhance the directivity of the circularly polarized wave, and to ultimately form a completely circularly polarized wave (a circularly polarized wave having 0 dB of the axial ratio of a long axis to a short axis), but it is not yet satisfied.

Since a conventional circular polarization microstrip line antenna has a configuration for transmitting and receiving only one of left-handed and right-handed circularly polarized waves, to receive and transmit both the left-handed and right-handed circularly polarized waves, it is necessary to prepare two of a microstrip line antenna for a left-handed circularly polarized wave and a microstrip line antenna for a right-handed circularly polarized wave and to connect them to a power supply, resulting in an increase in an entire size and complexity in an assembling and installing works.

It is convenient if both the left-handed and right-handed circularly polarized waves transmitted from one satellite can be received by one circular polarized microstrip line antenna. In this case, it is necessary to remarkably increase the directivity of the circular polarization microstrip line antenna. Accordingly, it is insufficient by a numeric value of the above-mentioned official gazette proposed at present.

Since the conventional receiver is constituted to process only a certain specific polarized wave, if the receiver receives a left-handed or right-handed polarized waves or a vertical or horizontal linearly polarized wave, it is necessary to install microstrip line antennas corresponding to the polarized waves and to prepare receives for the respective microstrip line antennas, and an overall increase in size cannot be avoided.

It therefore becomes necessary to solve the above-mentioned technical problem, so that the connecting configuration of the circular polarization microstrip line antenna to the power supply and the configuration of the power supply are simplified to enhance the efficiency of the assembling work, to simultaneously remarkably enhance the directivity, to transmit and receive both the left-handed and right-handed circularly polarized waves by one circular polarization microstrip line antenna while approaching the axial ratio to 0 dB and further to receive various polarized waves by one receiver, thereby improving the convenience of the antenna of this time, the power supply and the receiver. The object of the present invention therefore is to solve the above-mentioned technical problem.

SUMMARY OF THE INVENTION

In order to accomplish the above-mentioned object, the present invention provides a circular polarization microstrip line antenna and power supply comprising a microstrip line bent to a predetermined period wave shape such as a square wave on a surface of a board, a ground plane formed on a rear surface of the board, power supply units provided at both right and left ends of the microstrip line, wherein in the case of transmitting and receiving, one of the right and left power supply units is used as a power supplying point to transmit and receive right-handed and left-handed circularly polarized waves.

The invention provides a circular polarization microstrip line and power supply, wherein a dielectric sheet is laid on a metal plate, a flexible film is laid on the dielectric sheet, the microstrip line is formed on the surface of the flexible film to form the board, the power supply unit is formed in an inverted L shape, the horizontal part of the upper end of the power supply unit is interposed between the flexible film and the dielectric sheet, and the horizontal part and the ends of the microstrip line are opposed in parallel, a power supply according to claim 1, wherein a hole is perforated at the upper surface of the rectangular waves, a feeding pin is suspend by a predetermined amount in the cavity of the rectangular waveguide via the hole, and a probe is projected to a predetermined position of the lower surface of the cavity of the rectangular waveguide, and a power supply, wherein parabola waveguides each having a parabolic surface of a parabolic shape as seen in plane at a peripheral side and a chordal surface for forming the chord of the parabola and oppositely arranged at both right and left sides, holes are perforated at the upper surface of the parabola waveguide and the vicinity of the chordal surface, feeding pins are suspended by a predetermined amount to the cavity of the parabola waveguide via the holes, and a probe is projected to the focus of the parabola at the lower surface of the cavity of the parabola waveguide.

The invention provides a circular polarization microstrip line antenna and power supply, wherein a dielectric sheet is laid on a metal plate, a flexible film is laid on the dielectric sheet, a microstrip line is formed on the surface of the flexible film to form the board, rectangular waveguides are arranged under both right and left ends of the board, slits are perforated at the upper surface of the rectangular waveguide, both the right and left ends of the flexible film are bend down inserted to the slits to suspend the ends of the microstrip line to the cavity of the rectangular waveguide and to project the probe to the predetermined position of the lower surface of the cavity of the rectangular waveguide, and a circular polarization microstrip line antenna and power supply, wherein a dielectric sheet is laid on a metal plate, a flexible film is laid on the dielectric sheet, a microstrip line is formed on the surface of the flexible film to form the board, right and left opposed parabola waveguides each having a parabolic surface of a parabolic shape as seen in plane at a peripheral side and a chordal surface for forming the chord of the parabola are arranged under the board, slits are perforated at the upper surface of the parabola waveguide and the vicinity the chordal surface, both the right and left ends of the flexible film are bent down to be inserted to the slits to suspend the end of the microstrip line by a predetermined amount to the cavity of the parabola waveguide, and the probe is projected to the focus of the parabola of the lower surface of the cavity of the parabola waveguide.

The invention provides a power supply, wherein a partition plate fixed to the chord and separated at the peripheral edge by a predetermined amount from the parabolic surface is mounted in the cavity of the parabola waveguide.

The invention provides a circular polarization microstrip line antenna comprising a microstrip line of a square wave shape formed on a front surface of a board, a ground plane formed on a rear surface of the board to transmit and receive a circularly polarized wave, wherein the lengths of an upper side, a lateral side and a bottom side for constituting the square wave shape are set to about 0.90, 0.35 and 0.40 times as large as the line wavelength.

Further, the invention provides a circular polarization microstrip line antenna comprising a microstrip line of a square wave shape formed on a front surface of a board, a ground plane formed on a rear surface of the board to transmit and receive a circularly polarized wave, wherein the lengths of an upper side, a lateral side and a bottom side for constituting the square wave shape are set to about $0.90\tau$, $0.35\tau$ and $0.40\tau$ (where $\tau$ is a correction factor) times as large as the free space wavelength, and a circular polarization microstrip line antenna, wherein when the dielectric constant of the board is remarkably near "1", the value of the $\tau$ is set to $1.042\pm5\%$.

The invention provides a receiver loading a microstrip line antenna comprising a microstrip line of a predetermined period shape such as a square wave formed on a front surface of a board, a ground plane formed on a rear surface of the board to absorb a circularly polarized wave or a linearly polarized wave, wherein power supply units are provided at both right and left ends of the microstrip line, selecting means for setting one of both the right and left power supply units as a power supply point, thereby receiving the left-handed and right-handed circularly polarized waves or a vertical and horizontal linearly polarized waves.

The invention provides a receiver loading a microstrip line antenna, wherein the microstrip line is formed in a square wave shape, and the lengths of an upper side, a lateral side and a bottom side for constituting the square wave shape are set to about 0.90, 0.35 and 0.40 times as large as the line wavelength, thereby absorbing the circularly polarized waves.

DESCRIPTION OF THE PREFERRED EMBODIMENTS

Figure 1:
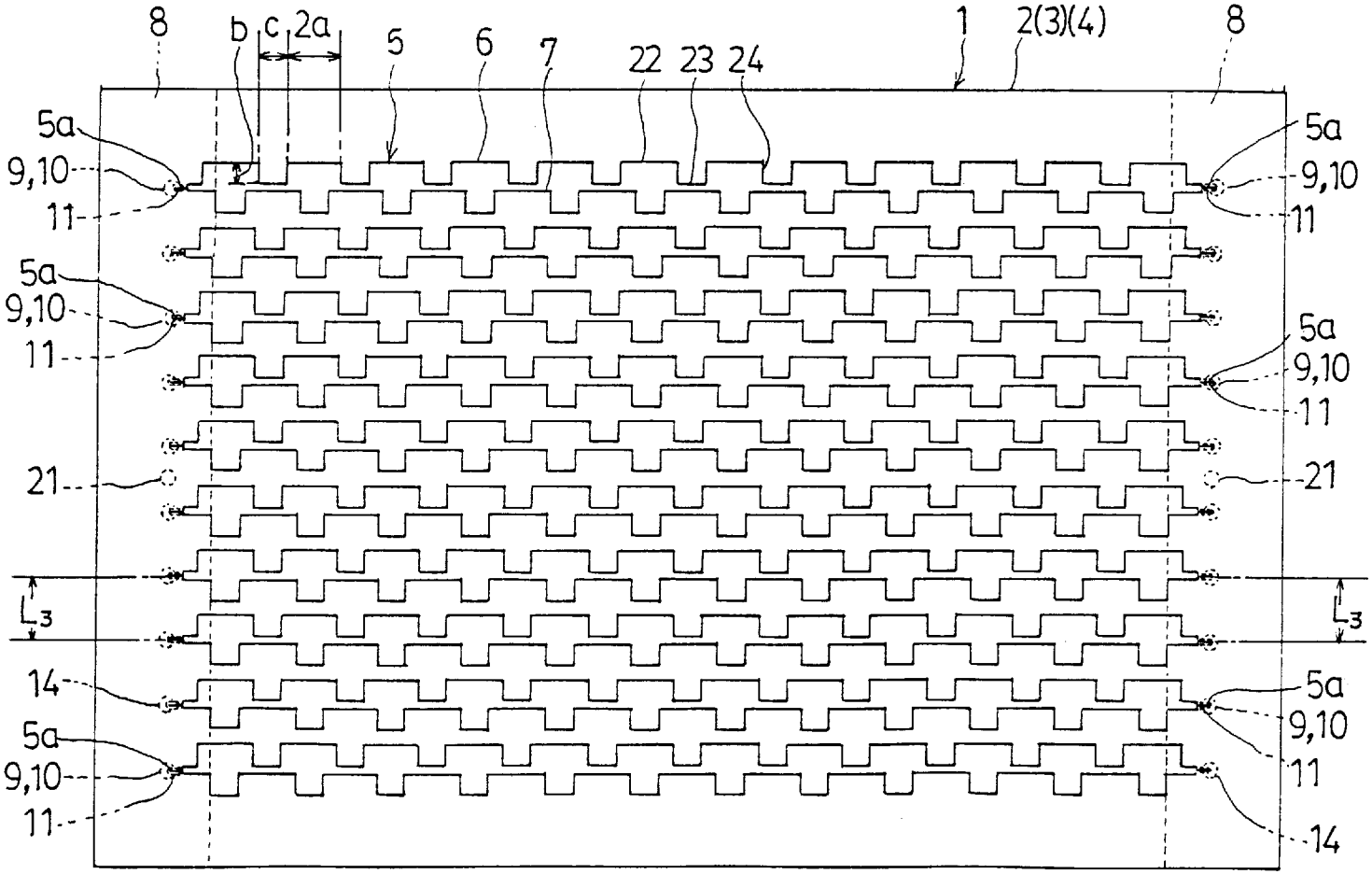
FIG. 1 is a plan view of an embodiment of the present invention of claims 1 to 3.
Figure 2:
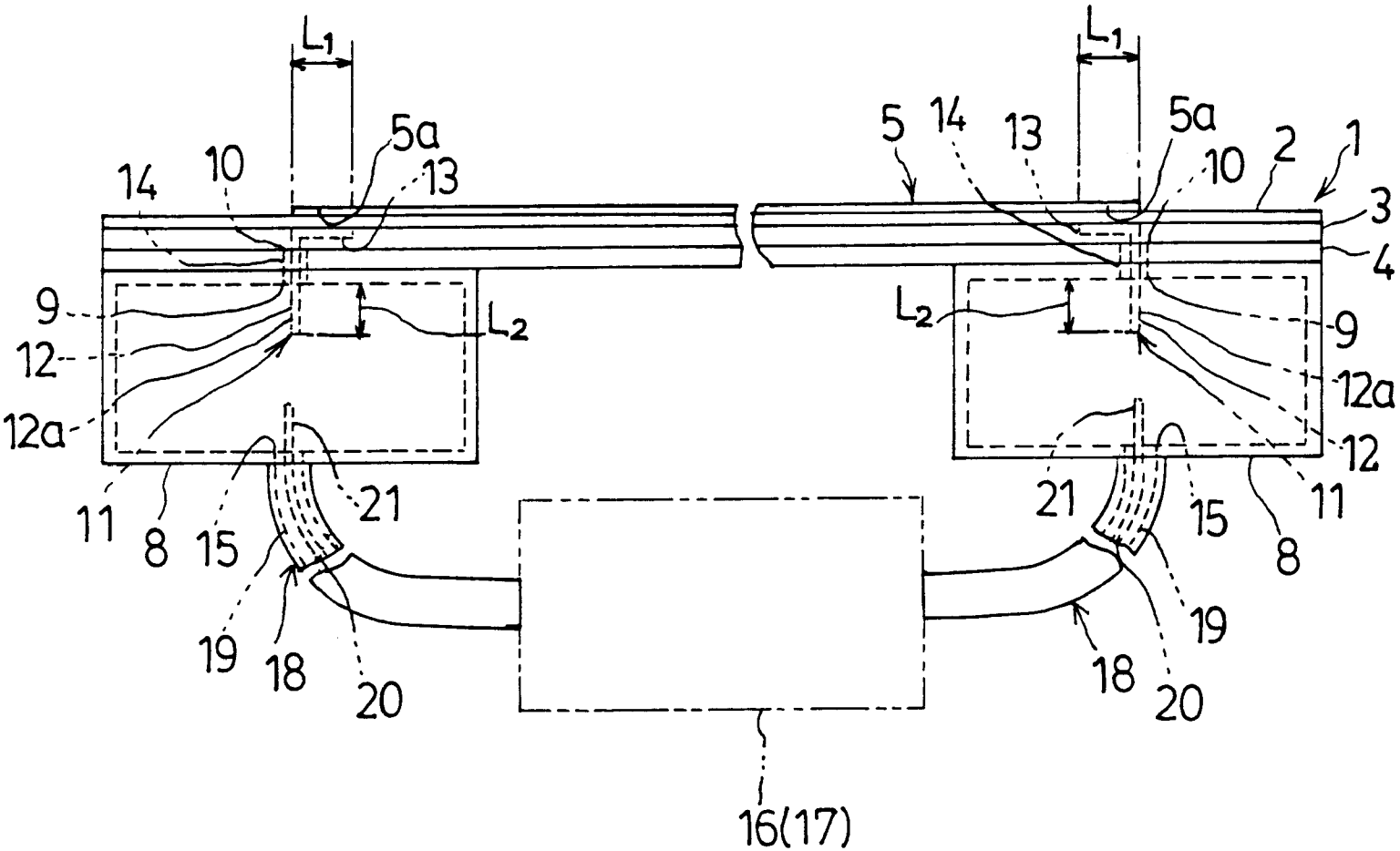
FIG. 2 is a front view partly cut out in FIG. 1.

Embodiments of the present invention will now be described in detail. An embodiment of the present invention of claims 1 to 3 will be first described by referring to FIGS. 1 and 2. In FIGS. 1 and 2, reference numeral 1 denotes a board for constituting a circular polarization microstrip line antenna. The board 1 includes three layers of a flexible film 2, a dielectric sheet 3 and a metal base 4 from above. The flexible film 2 is formed in a flexible thin plate state of synthetic resin of a material in which its dielectric constant is extremely near "1", and the surface of the film 2 is patterned with microstrip lines 5 by etching a conductive foil or screen printing conductive paste. The dielectric sheet 3 is formed of dielectric material in which its dielectric constant is extremely near "1" such as foam sponge. Further, the metal base 4 has, in addition to the function as a ground plane covering the entire rear surface of the board 1, a role of a support member for reinforcing the flexible film 2 and the dielectric sheet 3 to hold it in a planar state since the film 2 and the sheet 3 are extremely soft.

The microstrip lines 5 are formed one by one along the lateral direction of the flexible film 2. Tens of the microstrip lines 5 are aligned at each predetermined interval in the longitudinal direction of the flexible film 2 thereby to constitute an antenna array. Further, the individual microstrip lines 5 are formed by two arms 6 and 7, which are bent in the same square wave shape, and so formed that the arm 7 has the positional relationship with the arm 6 180 degrees out of phase.

Rectangular waveguides 8 are arranged in a longitudinal direction under both right and left ends of the board 1. According to the embodiment of the present invention, a standard product of WRJ-120 (standards of Electronic Industries Association of Japan) for transmitting a $TE_{10}$ basic mode is used as the rectangular waveguides 8. Ten holes 9 are perforated at each predetermined interval along the tube axial direction at right and left intermediate positions on the upper surfaces of the rectangular waveguides 8, and the holes 9 are opposed one by one at the right and left ends of the microstrip lines 5.

Holes 10 are perforated similarly at the opposed positions to the holes 9 of the metal base 4. Vertical parts 12 of inverted L-shaped feeding pins 11 are inserted into the holes 9 and 10. The inverted L-shaped feeding pins 11 are inserted into the holes 9 and 10 from the upper surface of the dielectric sheet 3 before the flexible film 2 is laid on the dielectric sheet 3 after the dielectric sheet 3 is laid on the metal base 4. At this time, since the dielectric sheet 3 is formed of foam sponge as described above, the feeding pins 11 can be inserted even if holes are not separately perforated. The horizontal parts 13 of the feeding pins 11 are directed toward the right and left insides of the board 1. Thus, if the flexible film 2 is laid, the end 5*a* of the microstrip line 5 of the front surface is opposed in parallel to the horizontal part 13 via the flexible film 2 of the dielectric material. Dielectric spacers 14 are charged in air gaps between the feeding pins 11 and the holes 9 and 10.

The length $L_1$ between the end 5*a* of the microstrip line 5 and the horizontal part 13 of the feeding pin 11 is so set as to electromagnetically couple the both to radio wave to be transmitted and received. Specifically, it is preferable to set the line wavelength g to $L_1=g/4$ when the radio wave to be transmitted and received is propagated at the microstrip line 5. Since the dielectric constant of the board 1 is extremely near "1" in the embodiment of the present invention, if the free space wavelength of the radio wave to be transmitted and received is $_0$, $g\approx_0$ is satisfied, and hence $L_1\approx_0/4$ is satisfied.

A hole 15 is perforated at the center of the lower surface of the rectangular waveguide 8, the insulating tube conductor 19 of the coaxial cable 18 extended from a transmitter 16 (or a receiver 17) is engaged with the hole 15, and the central conductor 20 of the coaxial cable 18 is projected into the cavity of the rectangular waveguide 8, thereby forming a probe 21. Thus, the feeding pin 11 is electromagnetically bridged to the probe 21 via the rectangular waveguide 8 to constitute a power supply.

Though concrete illustration is omitted, the length $L_2$ of the part 12*a* suspended from the upper surface of the cavity of the rectangular waveguide 8 of the vertical part 12 of the feeding pin 11 is shorter at the feeding pin 11 disposed nearer the center of the rectangular waveguide 8, and longer toward the front and rear ends. The reason will be described in the case of the transmission. The radio wave radiated from the probe 21 to the cavity of the rectangular waveguide 8 is attenuated to be propagated toward the front and rear ends in the cavity, and hence when the lengths $L_2$ of the suspended parts 12*a* of all the feeding pins 11 are set to the same, the feeding pin 11 disposed remotely from the probe 21 receive less energy. Thus, the amplitude of the current supplied to the microstrip line 5 is larger at the nearer to the center of the longitudinal direction of the board 1, and smaller toward the front and rear end of the board 1, thereby deteriorating the characteristics of the antenna array. Therefore, the length $L_2$ of the suspended part 12*a* is regulated as described above so as to bring the energy received by all the feeding pins 11 into coincidence, thereby supplementing the transmission loss of the rectangular waveguide 8.

The interval $L_3$ of the adjacent feeding pins 11, i.e., the interval of the adjacent microstrip lines 5 is so set as to be equal to the wavelength $g_1$ in the tube of the rectangular waveguide 8. This is because it is necessary to bring all the feeding pins 11 in the phase in the tube of the position where the feeding pins 11 are disposed into coincidence. Thus, all the feeding pins 11 can supply currents of the same phase and amplitude to the microstrip lines 5.

The transmitter 16 (or the receiver 17) has functions of selecting to conduct one of the right and left coaxial cables 18 to and separating the other. Accordingly, in the case of transmitting, if the coaxial cable 18 of the left side is selected by the transmitter 16, the high-frequency current oscillated from the transmitter 16 is introduced into the probe 21 at the end via the left side coaxial cable 18, the rectangular waveguide 18 of the left side is excited, and the energy is propagated to the feeding pin 11 on the upper surface of the rectangular waveguide 8, i.e., the feeding pin 11 disposed along the left end of the board 1. Further, the energy is propagated from the horizontal part 13 of the feeding pin 11 to the end 5*a* of the left side of the microstrip line 5 directly above the horizontal part 13 of the feeding pin 11 by electromagnetic coupling. Thus, the high-frequency current is supplied from the end 5*a* of the left side to the microstrip line 5. In this manner, the case that the feeding pin 11 of the left side is operated as a power supplying point is heretofore called "a left side power supply".

In the case of such left side power supply, a right-handed circularly polarized wave is radiated by the synergistic action of the time and spatial sine wave of the high-frequency current and the spatial square wave shape of the microstrip line 5. The process of the right-handed circularly polarized wave will be described by referring to FIGS. 3 and 4.

Figure 3A:
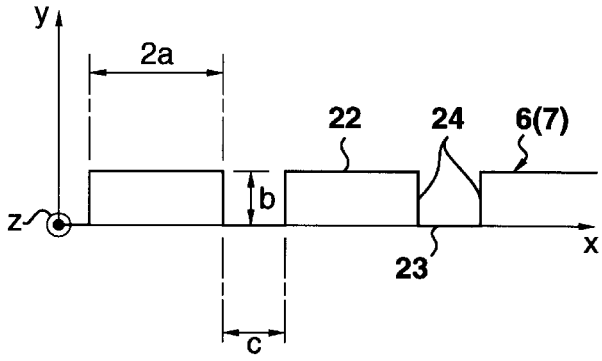
FIG. 3(*a* ) is an explanatory plan view illustrating X-Y-X space coordinates set on a board, FIG. 3(*b*) is a graph illustrating the time change of an electric field component $E_x$ at an arbitrary point on a Z-axis when a certain time is "0" in the case of a left-side power supply, and FIG. 3(*c*) is a graph illustrating the time change of an electric field component $E_y$ under the condition of FIG. 3(*b*)
Figure 3B:
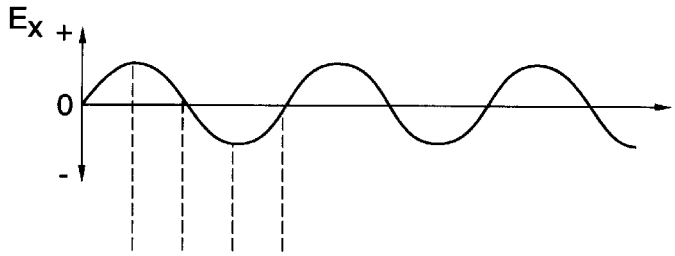
Figure 3C:
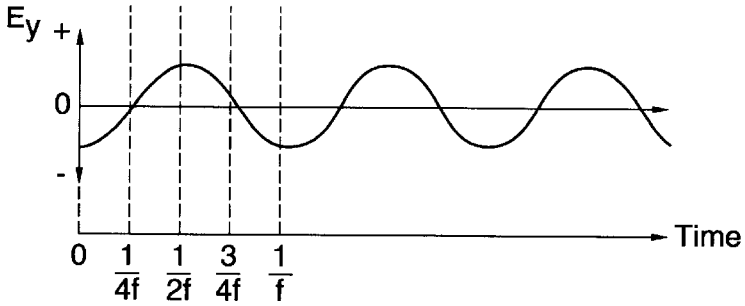

Referring to FIG. 3(*a*), an origin is provided on the surface of the board 1, a Z-axis (this side direction of the paper is set to a positive direction) is taken in the lateral direction of the board 1, and a Y-axis (the front direction (the upward direction of the paper) is set to a positive direction) is taken in the longitudinal direction of the board 1. Accordingly, the upper side 22 and the bottom side 23 for constituting the square wave shapes of the arms 6 and 7 of the microstrip line 5 are parallel to the X-axis, and the side 24 is parallell to the Y-axis. The high-frequency current flows along the arms 6 and 7, and hence the positive and negative directions of the X-axis and the positive and negative directions of the Y-axis are set in the direction of the high-frequency current.

In the microstrip line antenna of this type, an electromagnetic wave having an electric field of the amplitude proportional to the amplitude of the high-frequency current is radiated in the normal direction of the surface of the board 1. Therefore, an electric field E of the electromagnetic wave radiated from the board 1 has a component $E_x$ vibrated in the X-axis direction and a component $E_y$ vibrated in the Y-axis direction, and is propagated in the positive direction of the Z-axis. The electric field component $E_x$ is generated due to the high-frequency current flowing to the upper side 22 and the bottom side 23, and the electric field component $E_y$ is generated due to the high-frequency flowing to the lateral side 24.

When the lengths of the upper side 22, the bottom side 23 and the lateral side 24 are respectively 2*a*, 2*c*, 2*b*, the concrete sizes have predetermined correlation with respect to the line wavelength g as will be described later. As a result of the "predetermined correlation", the electric field component $E_x$ operated at an arbitrary point on the Z-axis (positive direction) is drawn as the vibration waveform illustrated in FIG. 3(*b*) at a certain time as "0" by the operation of the high-frequency current flowing to the upper side 22 and the bottom side 23, and the electric field component $E_y$ formed at the arbitrary point is drawn as the vibration waveform illustrated in FIG. 3(*c*) at the same time as the certain time as "0" by the operation of the high-frequency current flowing to the lateral side 24. As understood from FIGS. 3(*b*) and 3(*c*), both the electric field components $E_x$ and $E_y$ are together sine waves of the same period as the high-frequency current, and the electric field component $E_y$ is vibrated in lag phase by one period (90 degrees) of ¼ of the electric field component $E_x$. In FIGS. 3(*b*) and 3(*c*), when the electric field component $E_x$ or $E_y$ is disposed at the positive side, the direction of the electric field component $E_x$ or $E_y$ is illustrated to be the positive direction of the X-axis or the Y-axis, while when the component $E_x$ or $E_y$ is disposed at the negative side, the direction of the electric field component $E_x$ or $E_y$ is illustrated to be the negative direction of the X-axis or the Y-axis.

Figure 4:
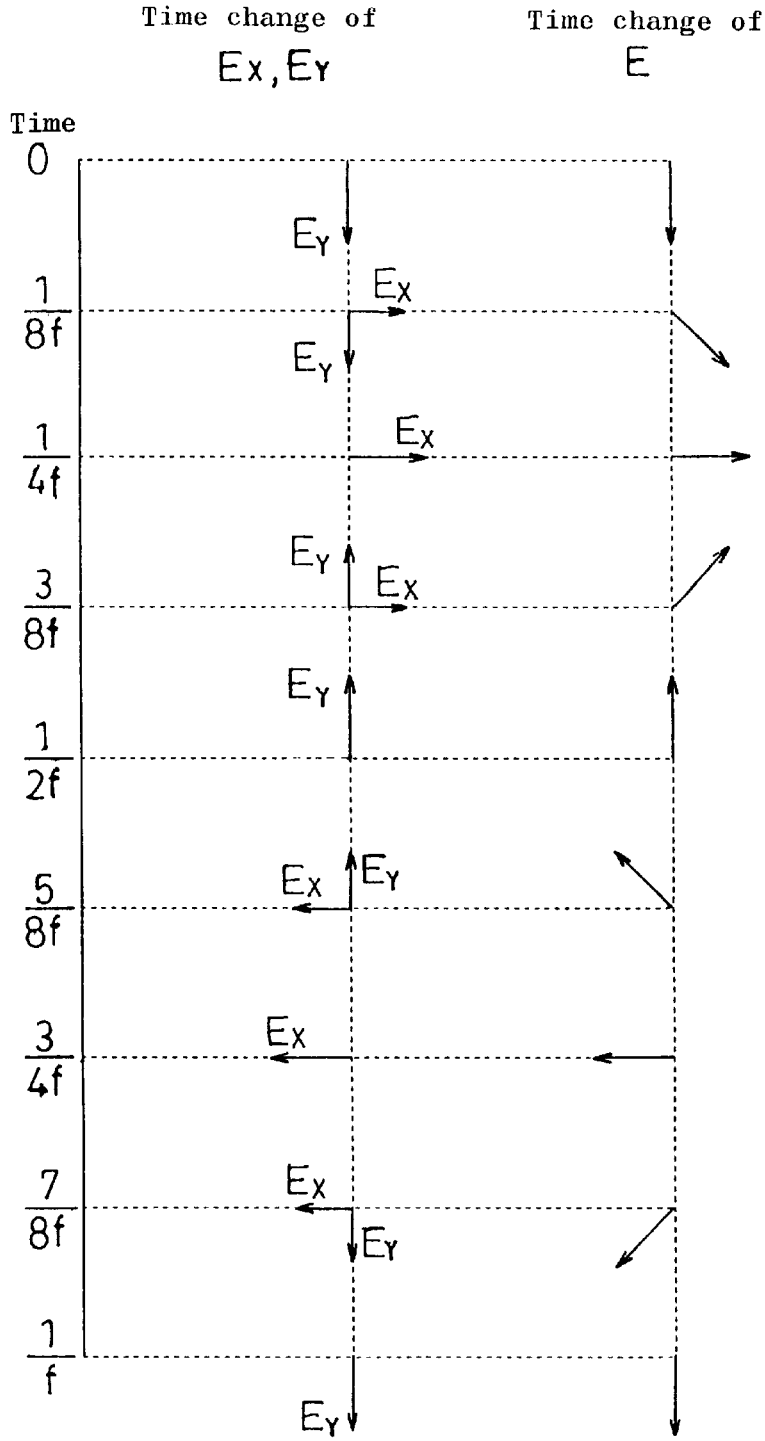
FIG. 4 is an explanatory view representing by a vector the direction and the amplitude of each one period of electric fields $E_x$ and $E_y$ and ⅛ of an electric field E synthesized with the electric field components based on FIGS. 3(*b*) and 3(*c*)

FIG. 4 illustrates by vector the amplitudes of the electric field components $E_x$ and $E_y$ (the row of the intermediate stage of FIG. 4) at an arbitrary point on the Z-axis and the electric field E synthesized with the components $E_x$ and $E_y$ at each period of ⅛ while considering the direction based on FIGS. 3(*b*) and 3(*c*). As understood from this, the electric field E is rotated counterclockwise toward the paper surface direction (the negative direction of the Z-axis, i.e., the reverse direction to the traveling direction of the electromagnetic wave) in the same period as the high-frequency current. Since whether the circularly polarized wave is a right-handed circularly polarized wave or a left-handed circularly polarized wave is determined according to the rotating direction of the electromagnetic field when the circularly polarized wave is directed toward the traveling direction (the positive direction of the Z-axis), the electromagnetic wave is the right-handed circularly polarized wave.

As described above, in the case of the left side power supply, the right-handed circularly polarized wave is radiated. Then, the case that the power supplying point is altered to the feeding pin 11 disposed at the left end of the board 1 to the right side power supply will be described.

To set the feeding pin 1 of the right end to a power supplying point, the transmitter 16 is connected to the coaxial cable 18 of the right side. Thus, the right side rectangular waveguide 8 is excited, and the high-frequency current is supplied from the end 5*a* of the microstrip line 5 of the right side via the feeding pin 11 of the right side. That is, as compared with the case of the left side power supply described above, in the case of the right side power supply, the direction of the current with respect to the X-axis direction is inverted by 180 degrees. This means that, if the right side power supply is executed, the electric field component $E_x$ illustrated in FIG. 3(*b*) is inverted at 180 degrees, and the result becomes the vibrating waveform shown in FIG. 5(*a*).

Figure 5A:
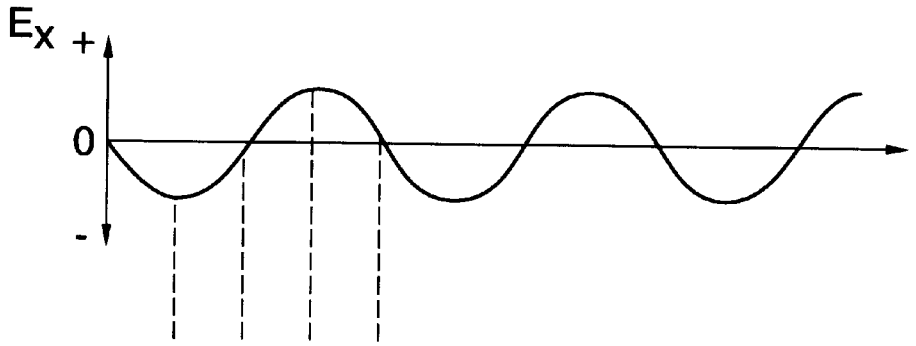
FIG. 5(*a*) is a graph illustrating the time change of an electric field component $E_x$ at an arbitrary point of a Z-axis when a certain time is "0" in the case of a right-side power supply, and FIG. 5(*b*) is a graph illustrating the time change of an electric field component $E_y$ under the condition of FIG. 5(*a*)
Figure 5B:
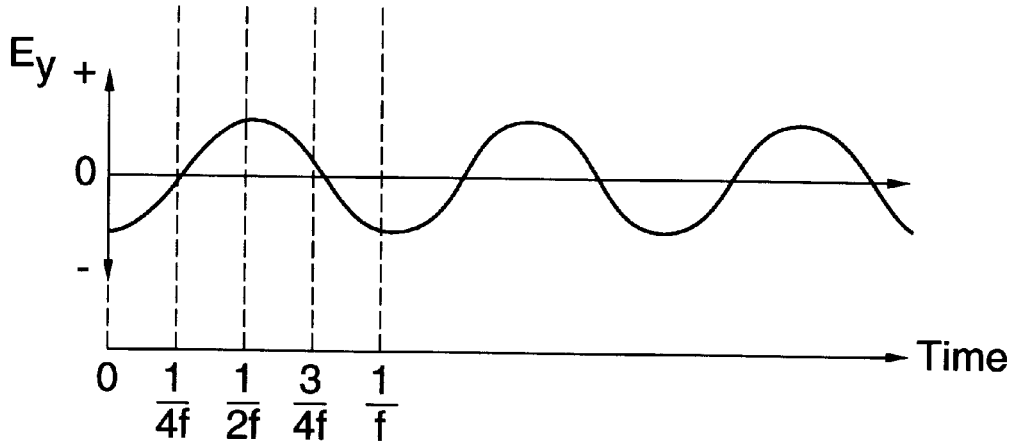

On the other hand, since the lateral side 24 (forward route) for forming the flow of the positive direction of the sides 24 of the microstrip line 5 is replaced by the lateral side 24 (return route) for forming the flow of the negative direction with respect to the Y-axis direction, the electric field component $E_y$ formed by the lateral side 24 as a whole is the same as the case of the left side power supply, and the vibration waveform is illustrated in FIG. 5(*b*). As understood from FIGS. 5(*a*)and 5(*b*), the case of the right side power supply, the electric field component $E_y$ is vibrated in the early phase by the period of ¼ (90 degrees) as compared with the electric field component $E_x$ oppositely to the case of the left side power supply described above.

Figure 6:
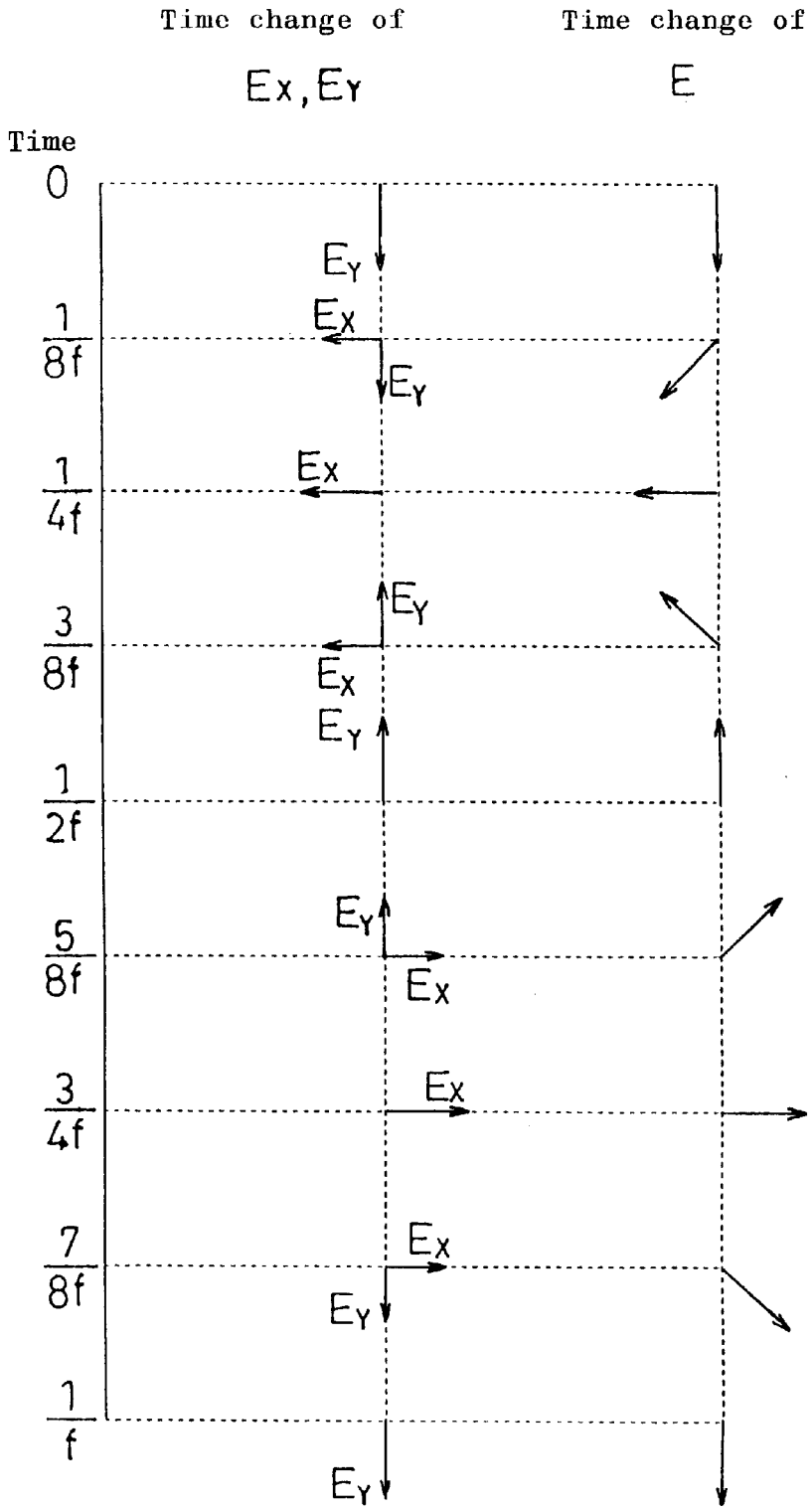
FIG. 6 is an explanatory view representing by a vector the direction and the amplitude of each one period of ⅛ of electric field components $E_x$ and $E_y$ and an electric field E synthesized with the electric field components based on FIGS. 5(*a*) and 5(*b*)

FIG. 6 illustrates the electric field vector change of each one period of ⅛ of the case of the right side power supply based on FIG. 5 corresponding to FIG. 4 in the case of the left side power supply described above. As illustrated in the row of the left end of FIG. 6, in the case of the right side power supply, the electric field E at the arbitrary point on the Z-axis is rotated clockwise at the same period as the high-frequency current toward the paper surface direction (the negative direction of the Z-axis). Accordingly, this electromagnetic wave is a left-handed circularly polarized wave.

As described above, when the left side power supply is executed at one board 1, the right-handed circularly polarized wave is radiated, while when the right side power supply is executed, the left-handed circularly polarized wave is radiated. If the transmitter 16 is altered to the receiver 17, the circularly polarized wave having the same characteristics as the circularly polarized wave radiated at the time of transmitting can be received, and hence in the case of the left side power supply by the one board 1, the right-handed circularly polarized wave can be received, while in the case of the right side power supply, the left-handed circularly polarized wave can be received.

Therefore, the conventional inconvenience in which both the circularly polarized waves cannot be transmitted and received if two sets of the microstrip line antenna for the right-handed circularly polarized wave and the microstrip line antenna for the left-handed circularly polarized wave are not combined can be eliminated, and hence the circular polarization microstrip line antenna of this type can be reduced in size.

Figure 7:
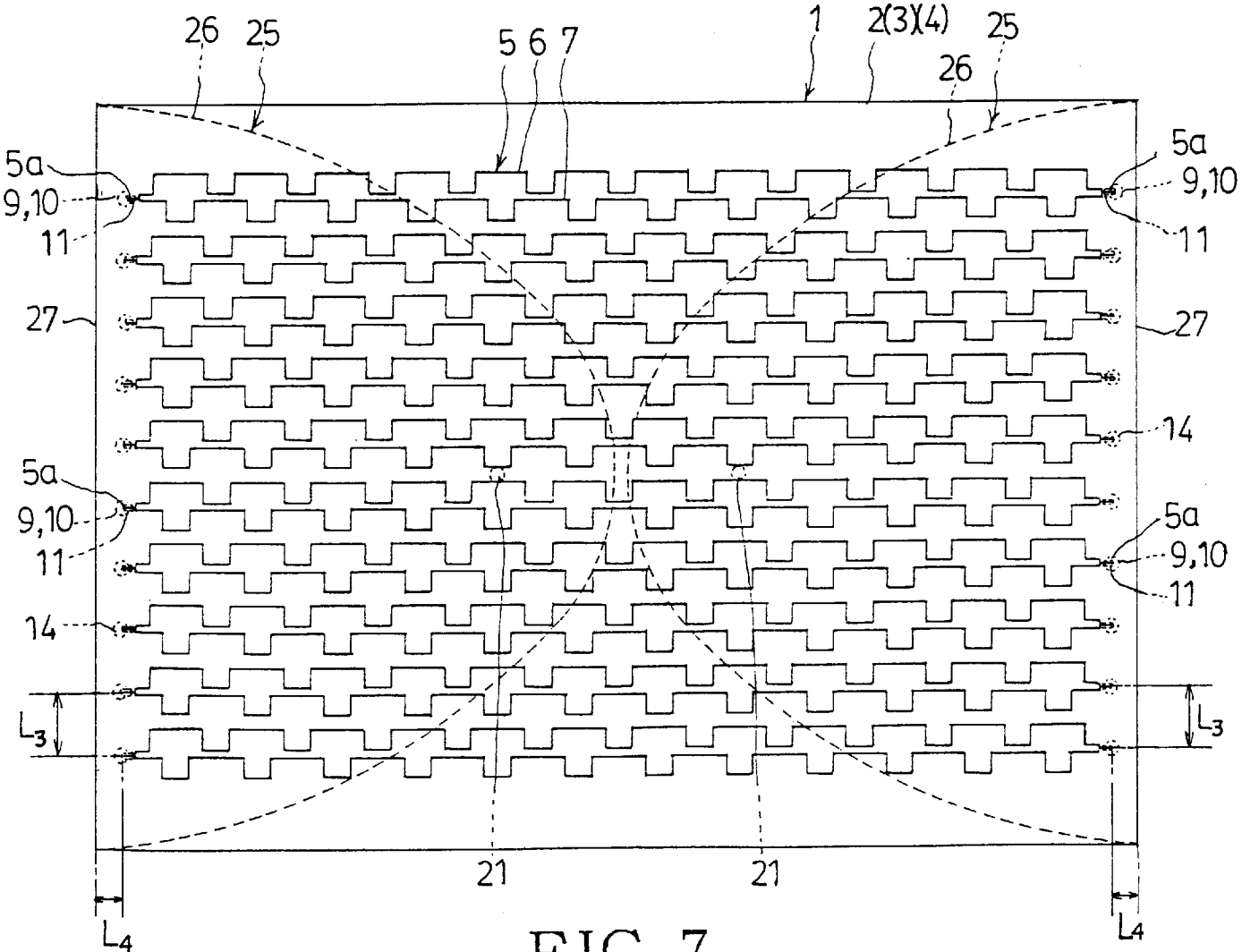
FIG. 7 is a plan view illustrating another embodiment of the present invention of claim 4.
Figure 8:
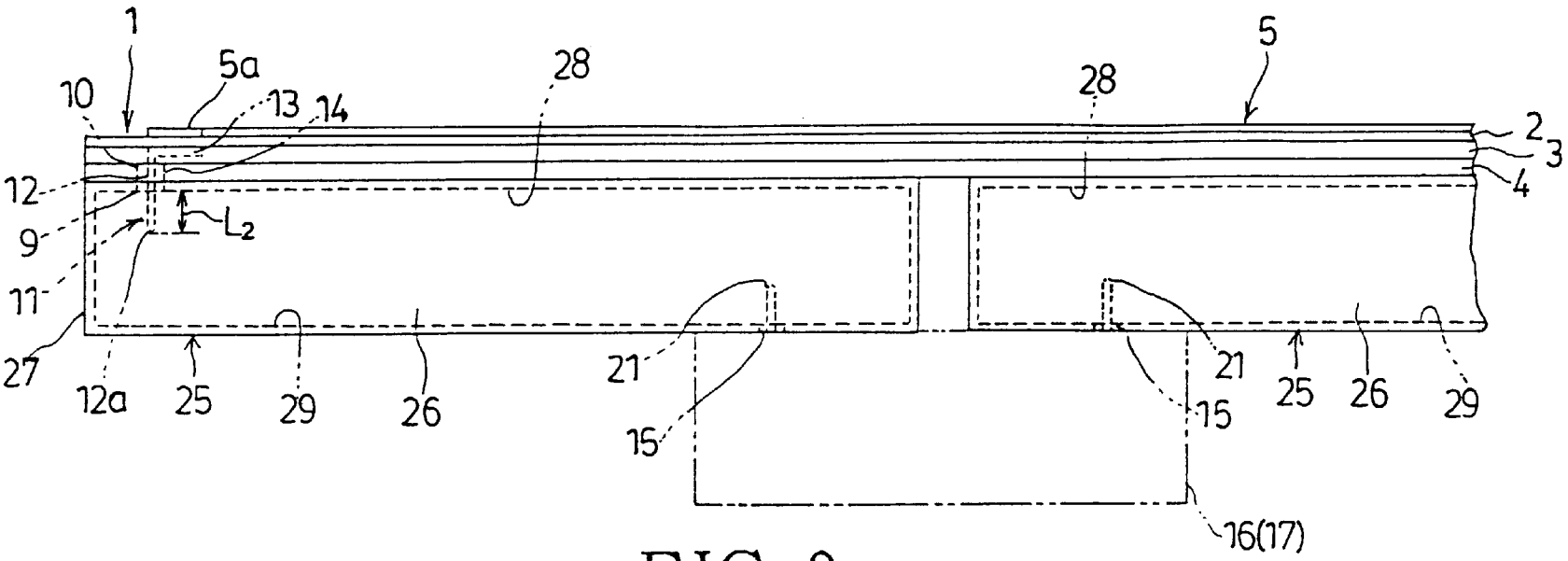
FIG. 8 is a front view partly cut out in FIG. 7.

Then, another embodiment of the present invention of claim 4 will be described by referring to FIGS. 7 and 8. The same parts as in the previous drawings are identified with the same reference numerals and the descriptions are omitted for the convenience of the description. In the embodiment of the present invention of claim 4, parabola waveguides 25 are arranged instead of the rectangular waveguides 8 laterally oppositely under a board 1. The peripheral side surfaces of the parabola waveguides 25 each has a parabolic surface 26 formed in a parabolic shape as seen in plane and a chordal surface 27 for constituting the chord of the parabola. The chordal surface 27 is arranged along the right and left edges of the board 1, the parabolic surface 26 is symmetrically expanded with respect to the longitudinal centerline of the board 1 at the inside, and the end is arrived substantially in the vicinity of the center of the board 1.

Holes 9 for inserting feeding pins 11 are perforated along the chordal surface 27 at the upper surface 28 of the parabola waveguide 25. A distance $L_4$ between the holes 9 and the chordal surface 27 is so set that the traveling direction of the radio wave radiated from the feeding pin 11 into a tube becomes parallel to the lateral direction (X-axis direction) of the board 1. Accordingly, these radio waves are reflected by the parabolic surface 26, and then converged to the focus of the parabola for constituting the shape as seen in plane of the parabolic surface 26. A hole 15 is perforated at the focal position of the lower surface 29 of the parabola waveguide 25, and a probe 21 is projected from the hole 15 toward the cavity of the parabola waveguide 25. Thus, the probe 21 is electromagnetically bridged to the feeding pin 11 via the parabola waveguide 25.

Since the focus is disposed in the vicinity of the center of the board 1, right and left probes 21 are disposed adjacent to the vicinity of the center of the board 1. Accordingly, if a transmitter 16 (or a receiver 17) is disposed under the center of the board 1, the probes 21 can be projected directly from the transmitter 16 (or the receiver 17), and hence a coaxial cable 18 for connecting the probes 21 to the transmitter 16 (or the receiver 17) like the rectangular waveguide 8 described above is eliminated.

If either the right or left probe 21 is selected by the transmitter 16 (or the receiver 17), the parabola waveguide 25 of the selected side is excited, the feeding pin 11 disposed at the parabola waveguide 25 becomes a power supplying point, and the right-handed circularly polarized wave or the left-handed circularly polarized wave can be transmitted and received in the same manner as the case described above.

In the rectangular waveguide 8, it is necessary to severely set the length $L_2$ of the suspended part 12*a* of each feeding pin 11 and the distance (distance between the adjacent microstrip lines 5) $L_3$ between the adjacent feeding pins 11 so as to bring the phases and the amplitudes of the radio waves at the feeding pins 11. However, in this parabola waveguide 25, it is not necessary. That is, in the parabola waveguide 25, the propagating distance of the wave in the tube arriving at the probe 21 by the reflection of the parabolic surface 26 radiated from the feeding point 11 is the same as that radiated from all the feeding pins 11, and hence the phase and the amplitude of the radio wave converged to the probe 21 are indispensably brought into coincidence. Accordingly, when the parabola waveguide 25 is used, the feeding pins 11 are disposed in parallel along the chordal surface 27, and the length $L_2$ of the suspended part 12*a* may be set to the same for all the feeding pins 11, the degrees of freedom of the microstrip lines 5 and the feeding pins 11 is increased, and the design and assembly are facilitated.

Figure 9:
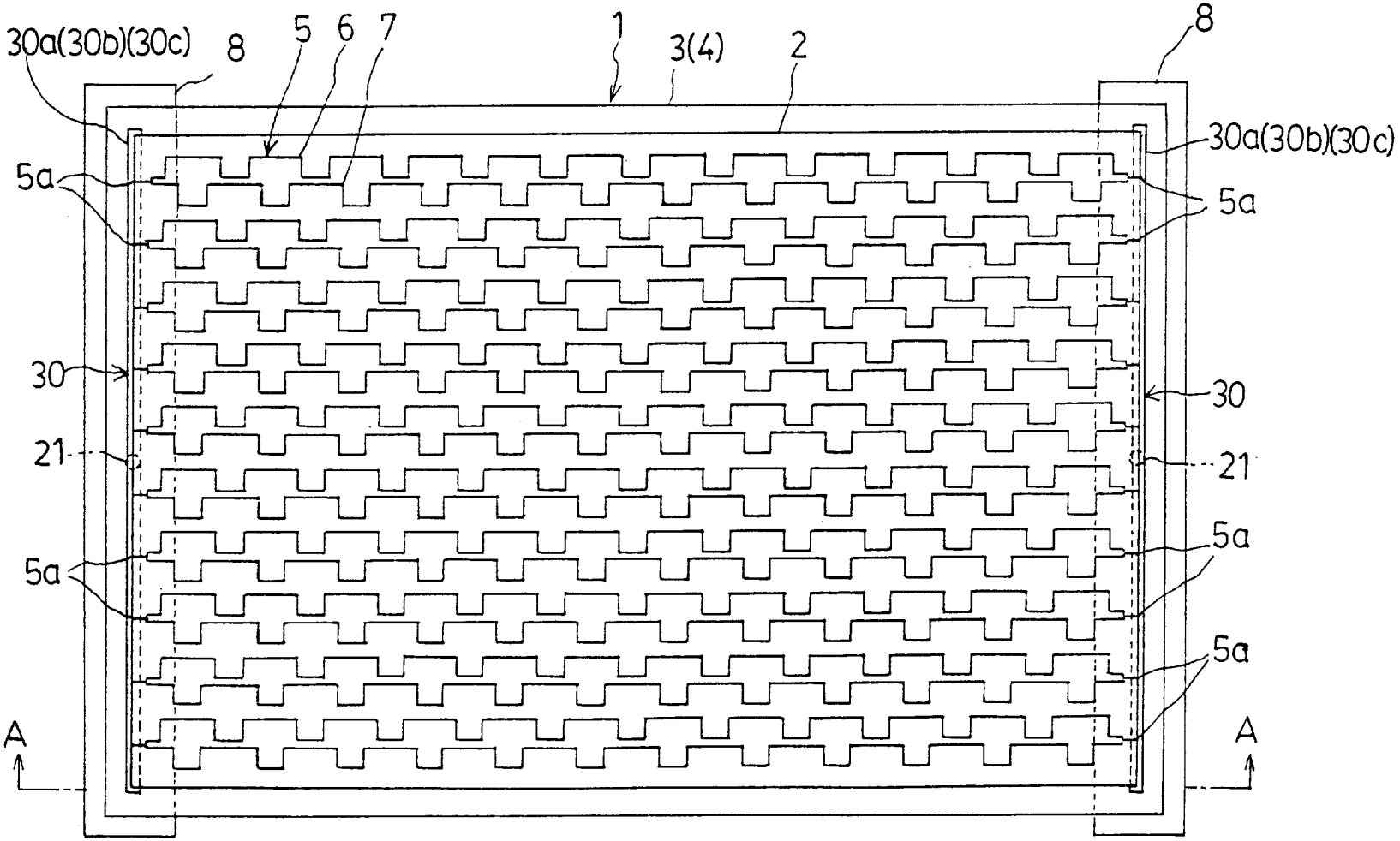
FIG. 9 is a plan view illustrating a further embodiment of the present invention of claim 5.
Figure 10:
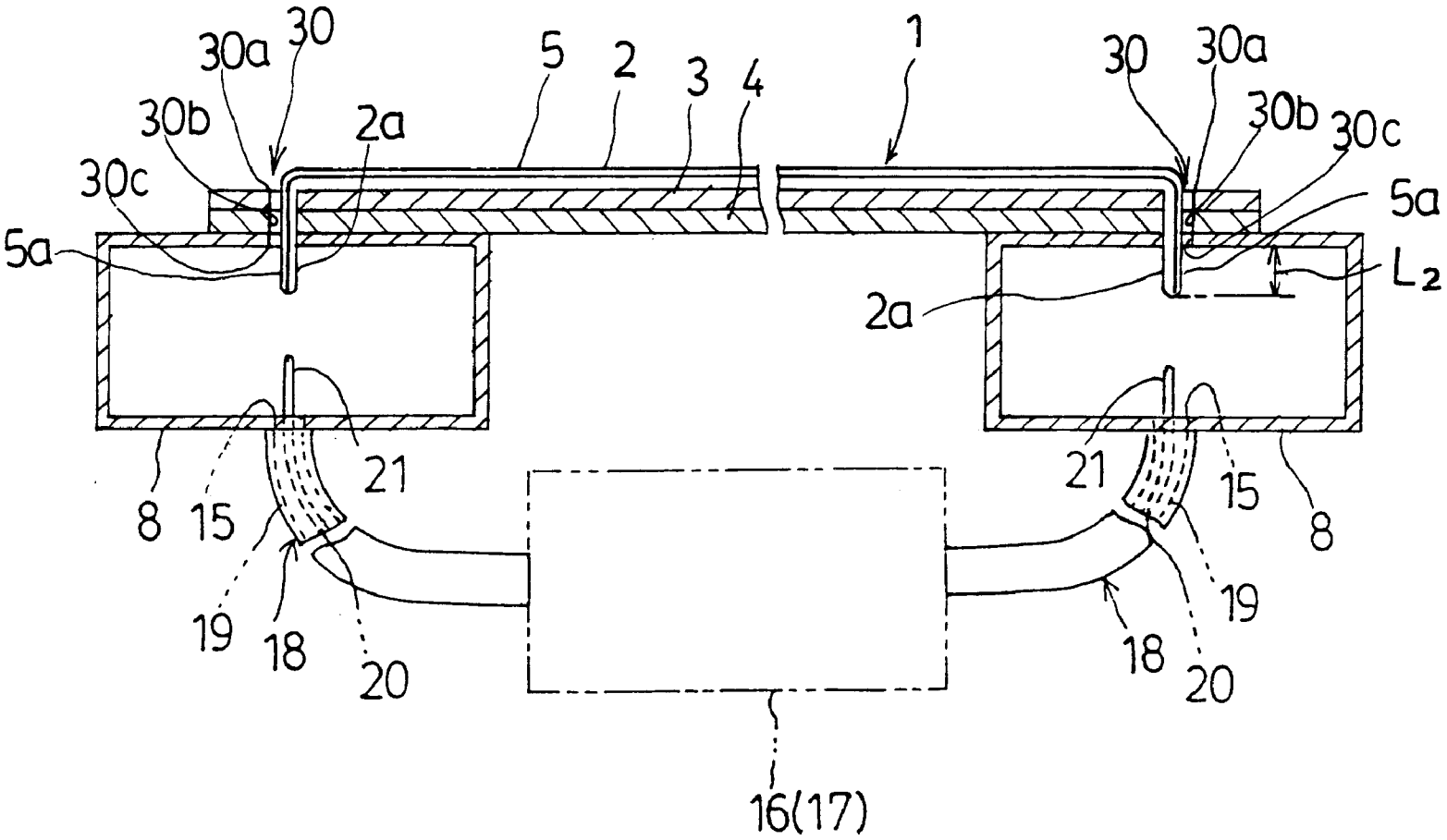
FIG. 10 is a sectional view along the line A—A partly cutout in FIG. 9.

Still another embodiment of the present invention of claim 5 will be described by referring to FIGS. 9 and 10. The same parts as in FIGS. 1 and 2 are identified with the same reference numerals and the descriptions are omitted for the convenience of the description. The still another embodiment of the present invention has rectangular waveguides 8 at both right and left ends of a board 1 in the same manner as the embodiment of the present invention illustrated in FIGS. 1 and 2, but slits 30*a* and 30*b* are opened along the right and left edges of a dielectric sheet 3 an a metal base 4 different from the embodiment of FIGS. 1 and 2, and a slit 30*c* is opened along a tube axis at the lateral center of the upper surface of the rectangular waveguide 8 opposed to the slits 30*a* and 30*b*.

The longitudinal length of a flexible film 2 is so formed to be substantially the same as the length of the slit 30. The right and left ends 2*a* of the flexible film 2 is bent down and inserted fixedly into the slit 30.

Therefore, the right and left ends 5*a* of microstrip lines 5 formed on the surfaces of the right and left ends 2*a* of the flexible film 2 are suspended by a length $L_2$ to the cavity of the rectangular waveguide 8. The length $L_2$ is shorter at the position nearer to the center of the rectangular waveguide 8 and longer at the position toward the front and rear ends similar to the length $L_2$ of the suspended part 12*a* of the feeding pin 11 in FIGS. 1 and 2 described above.

As described above, according to the still another embodiment of the present invention, the right and left ends 5*a* of the microstrip lines 5 are used as direct power supplying points to transmit and receive both the left-handed and right-handed circularly polarized waves without using the feeding point. Accordingly, an assembling work is more efficiently conducted.

Figure 11:
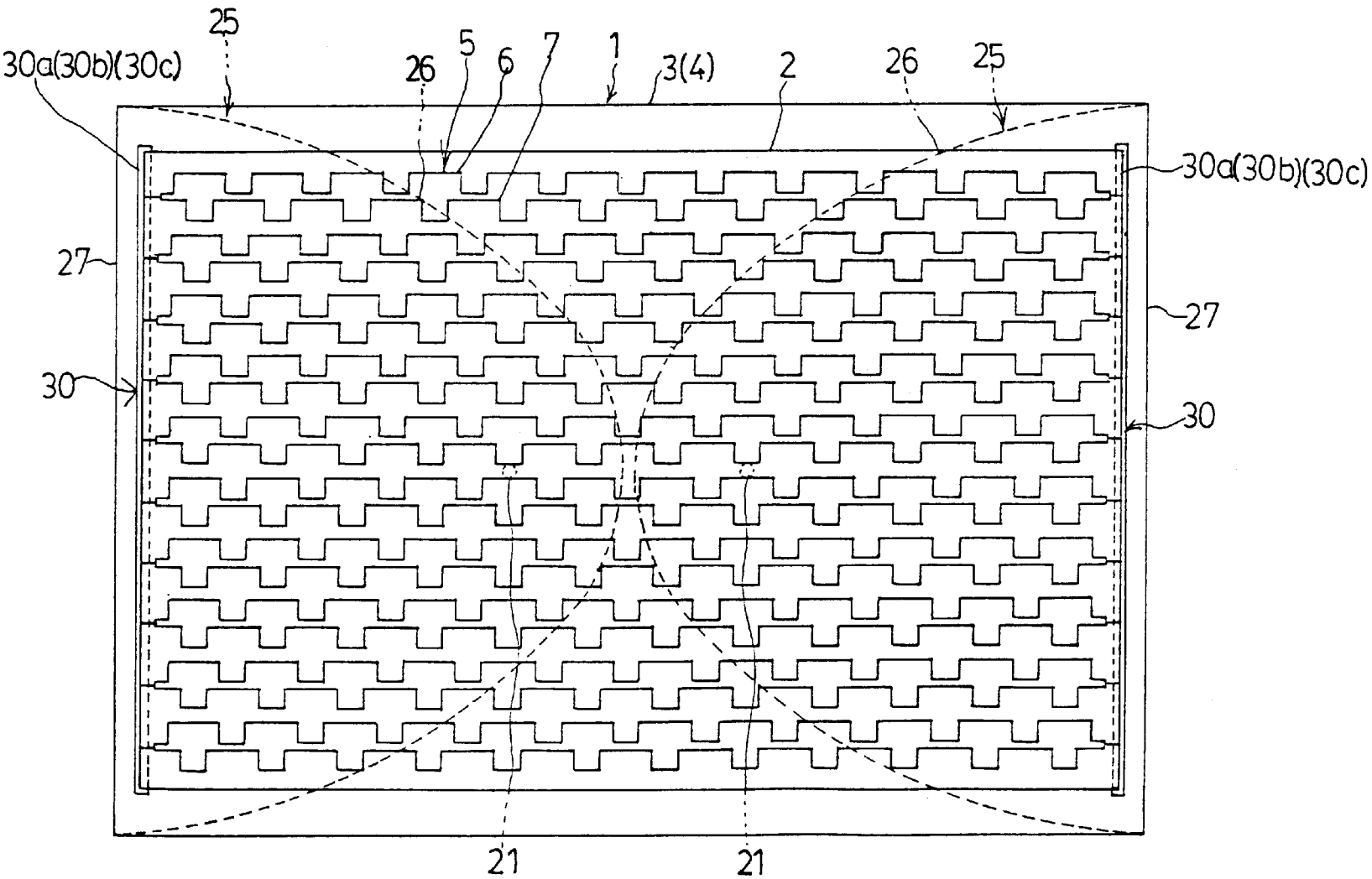
FIG. 11 is a plan view showing still another embodiment of the present invention of claim 6.
Figure 12:
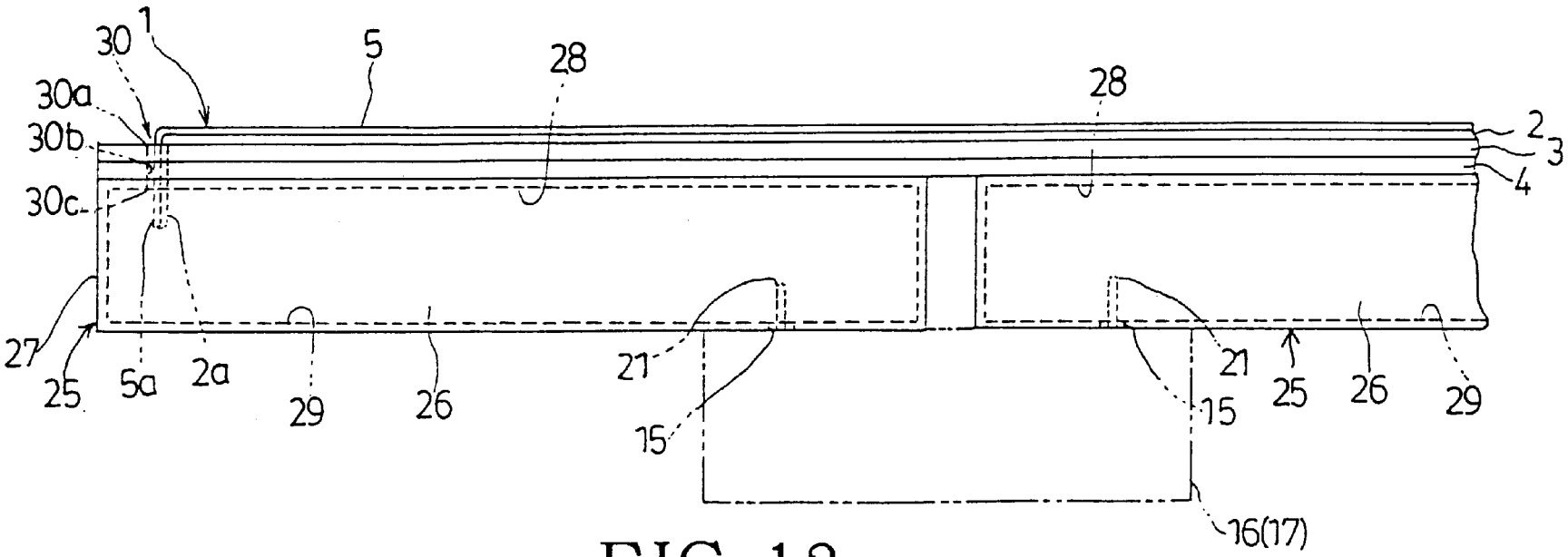
FIG. 12 is a front view partly cut out in FIG. 11.

A still another embodiment of the present invention of claim 6 will be described by referring to FIGS. 11 and 12. The same parts as in the previous drawings are identified with the same reference numerals and the descriptions are omitted for the convenience of the description. In the still another embodiment of the present invention, parabola waveguides 25 are arranged oppositely at the right and left of a board 1 similarly to the embodiment shown in FIGS. 7 and 8, and slits 30 (30*a*, 30*b*, 30*c*) are opened along a chordal surface 27 similarly to the embodiment illustrated in FIGS. 9 and 10 instead of the holes 9 in the embodiment shown in FIGS. 7 and 8 on the upper surface 28 of the parabola waveguide 25. Further, the right and left ends 2*a* of a flexible film 2 are bent down and inserted into the slits 30, and hence the right and left ends 5*a* of microstrip lines 5 are suspended by a predetermined amount to the cavity of the parabola waveguide 25.

As described above, in the still another embodiment of the present invention, the right and left ends 5*a* of the microstrip line 5 are used as direct power supplying points without using feeding pin, the left-handed and right-handed circularly polarized waves can be transmitted and received, and an assembling work can be further efficiently executed.

Figure 13:
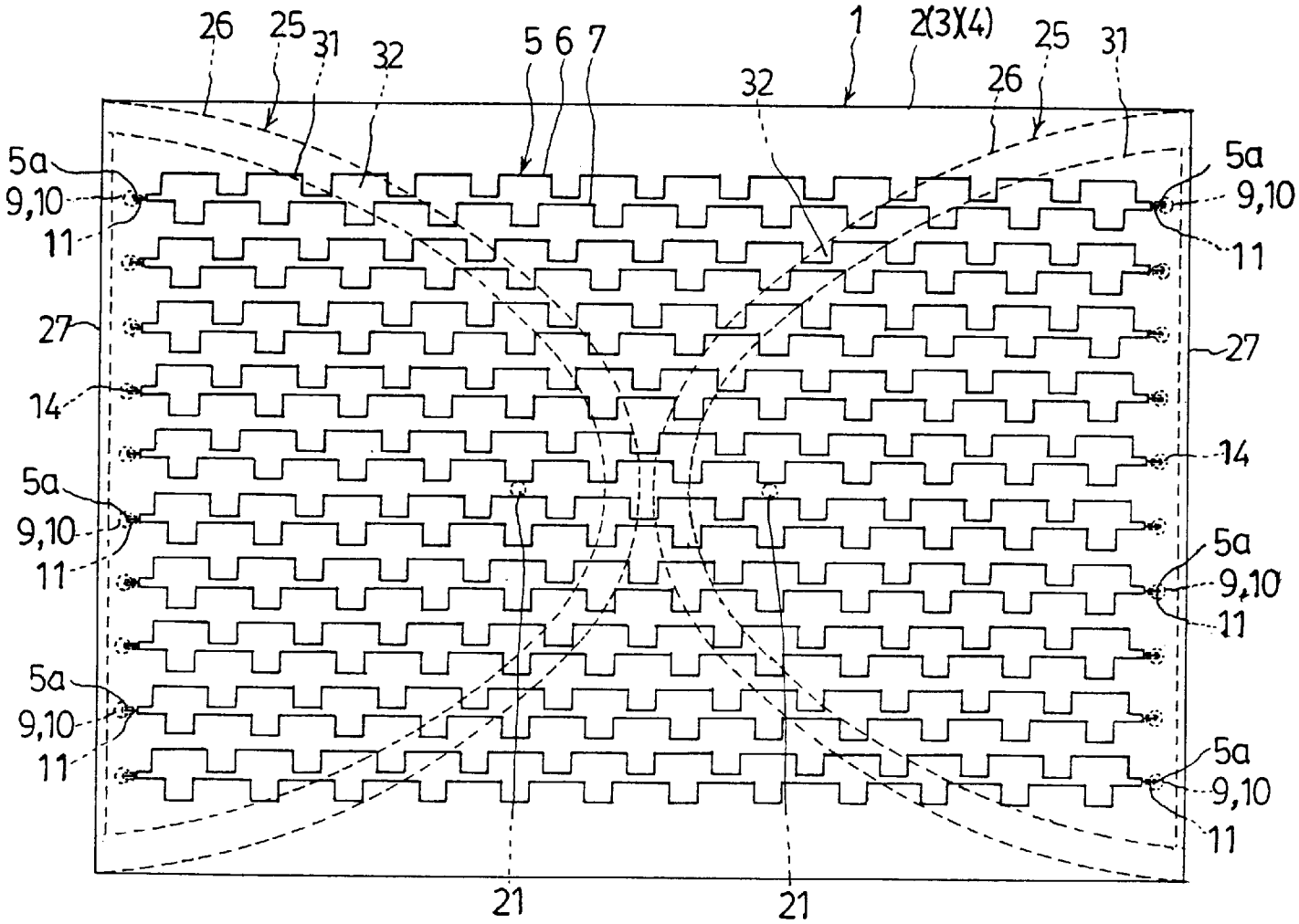
FIG. 13 is a plan view showing still another embodiment of the present invention of claim 7 of the improvement of the embodiment of claim 4.
Figure 14:
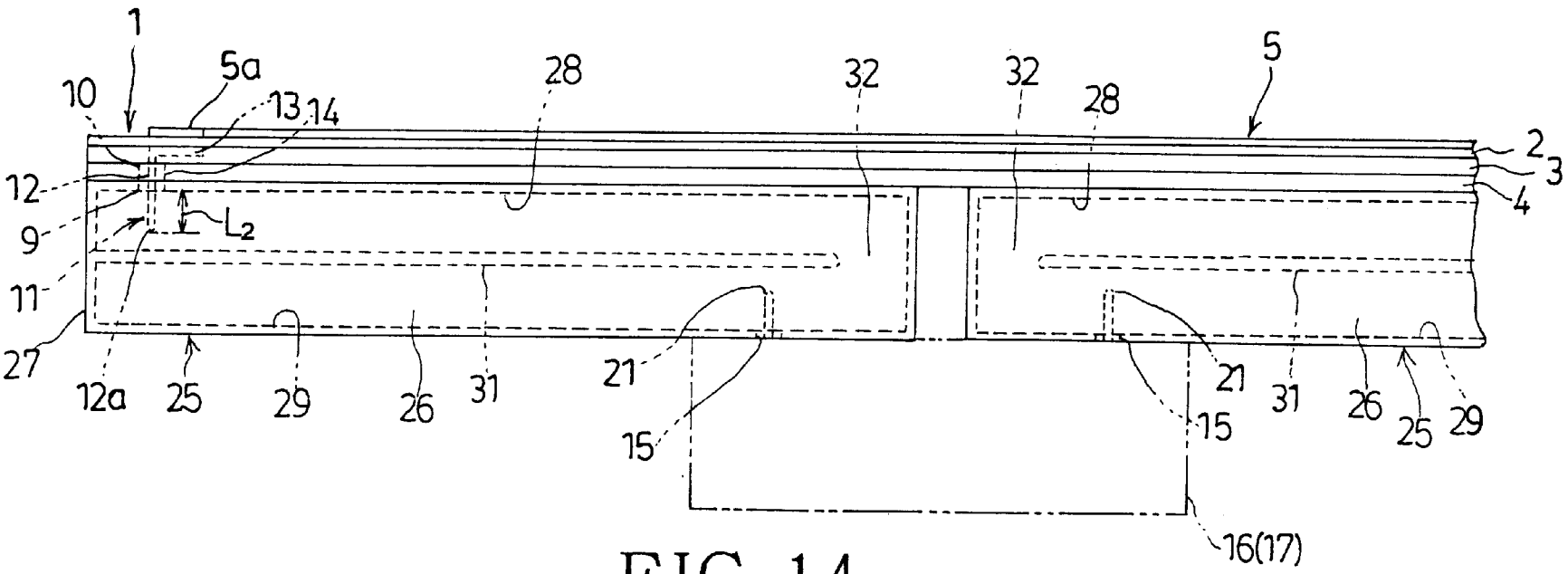
FIG. 14 is a front view partly cutout in FIG. 13.
Figure 15:
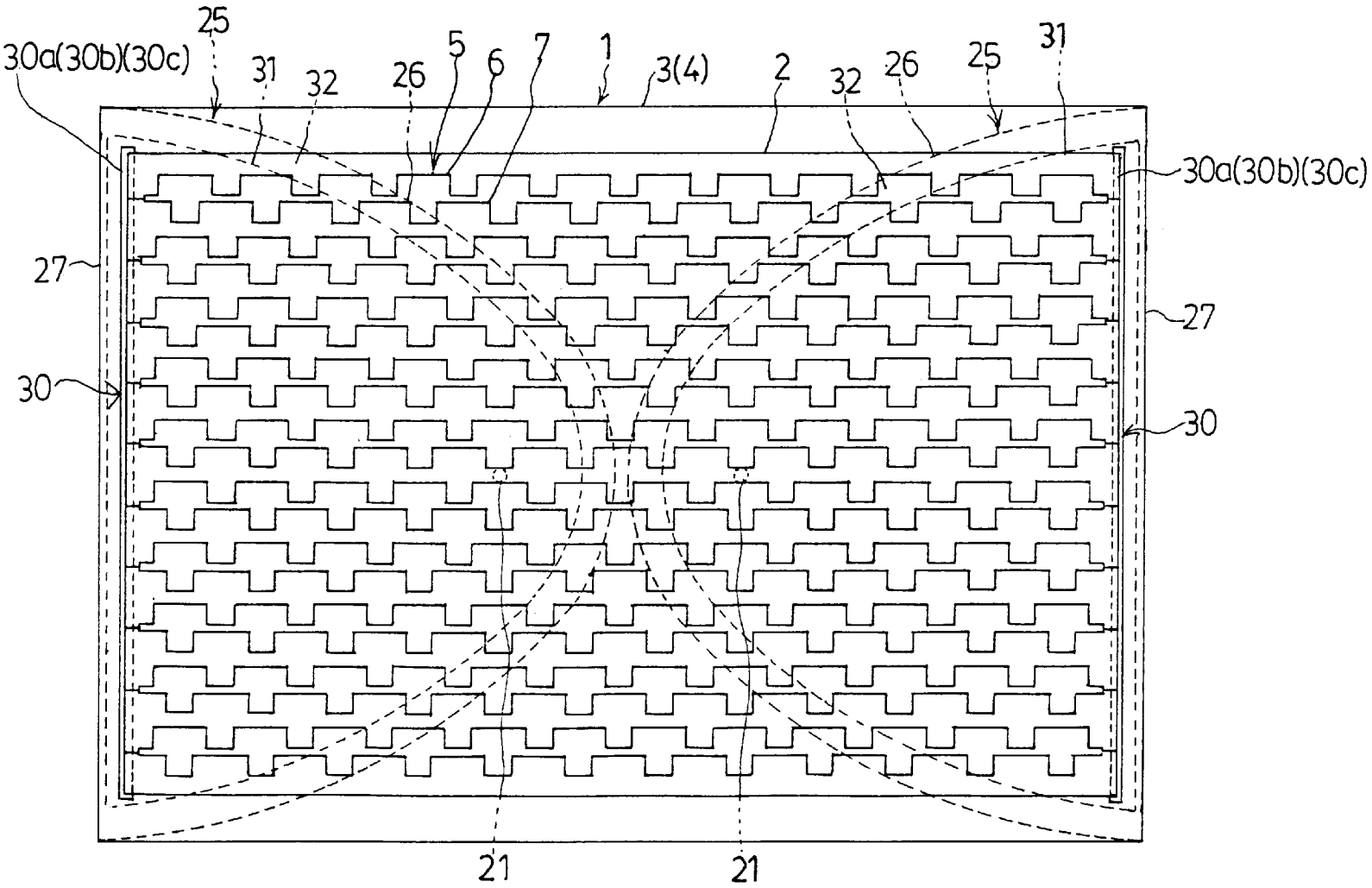
FIG. 15 is a plan view showing still another embodiment of the invention of claim 7 of the improvement of the embodiment of claim 6.
Figure 16:
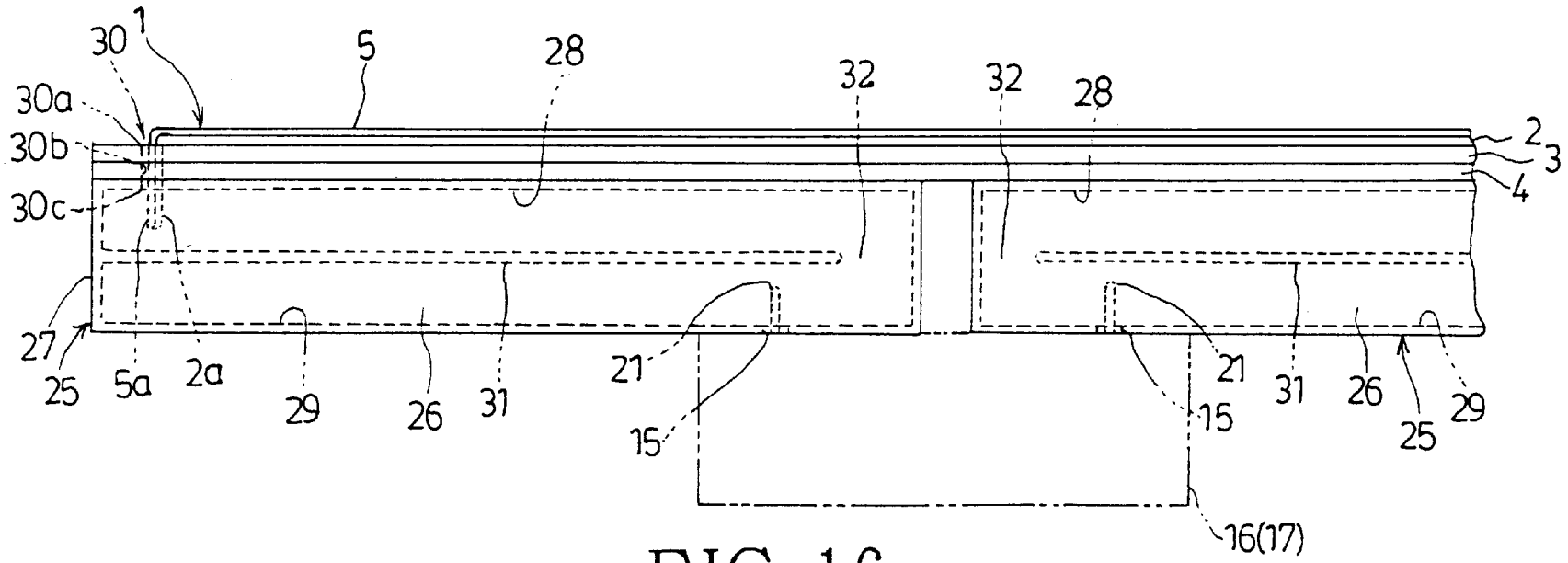
FIG. 16 is a plan view partly cut out in FIG. 15

Still another embodiment of the present invention of claim 7 will be described by referring to FIGS. 13 to 16. FIGS. 13 and 14 of the drawings relate to the improvements in the embodiment of claim 4 illustrated in FIGS. 7 and 8, and to the improvements in the embodiment of claim 6 illustrated in FIGS. 11 and 12.

The still another embodiment of the present invention different from the embodiment of FIGS. 7 and 8 and 11 and 12 resides in that a partition plate 31 is mounted in the cavity of a parabola waveguide 25. The partition plate 31 is horizontally fixed to the inner surface of the chordal surface 27 of the parabola waveguide 25, and its peripheral edge is formed with a gap 32 separately by a predetermined amount from the inner surface of the parabolic surface 26 while the peripheral edge draws a parabolic shape.

If there is no partition plate 31, the radio wave propagated directly from the probe 21 to the feeding pin 11 (or the end 5*a* of the microstrip line 5) without reflecting is considered in addition to the normal radio wave from the probe 21 by the reflection of the parabolic surface 26, such a direct wave is different in the phase and the amplitude from the normal radio wave, and hence noise is caused. On the other hand, if the partition plate 31 is provided, such direct wave can be shielded, and the radio wave for coupling the probe 21 to the feeding pin 11 (or the end 5*a*of the microstrip line 5) includes only the reflected wave which can pass above and below the partition plate 31 via the gap 32. Accordingly, the generation of noise is remarkably suppressed, and antenna performance is improved.

A still another embodiment of the present invention of claims 8 to 10 will be described. As described above, in the circular polarization microstrip line antenna which can transmit and receive the left-handed and right-handed circularly polarized waves as described above, it is obtained to remarkably improve the directivity. That is, if the directivity is wrong, when the azimuth of the antenna is matched by the one side circularly polarized wave, the deviation of the angle when the wave is switched to the other circularly polarized wave is doubled, and hence the azimuth must be again matched, and accordingly the merit of transmitting and receiving both the circularly polarized waves is canceled. Heretofore, various correlation formulae between the lengths of the sides for constituting a square wave shape and a line wavelength g have been proposed to enhance the antenna characteristics of the circular polarization microstrip line antenna of this time. However, there is not yet a complete circular polarized microstrip line antenna. Particularly, it is inadequate for the circular polarized microstrip line antenna for transmitting and receiving the above-described left-handed and right-handed circularly polarized waves.

The important operation is executed for the circular polarization characteristics of the upper side, the lateral side and the bottom side for constituting a square wave shape by the lateral side. If the length of the lateral side is specified, the lengths of the upper side and the bottom side can be empirically calculated. The total length of the upper side, the lateral side and the bottom side (2*a*+*b*+*c*) in FIGS. 1 and 3(*b*) is the empirically recognized condition in the doubling of the line wavelength g.

Figure 17:
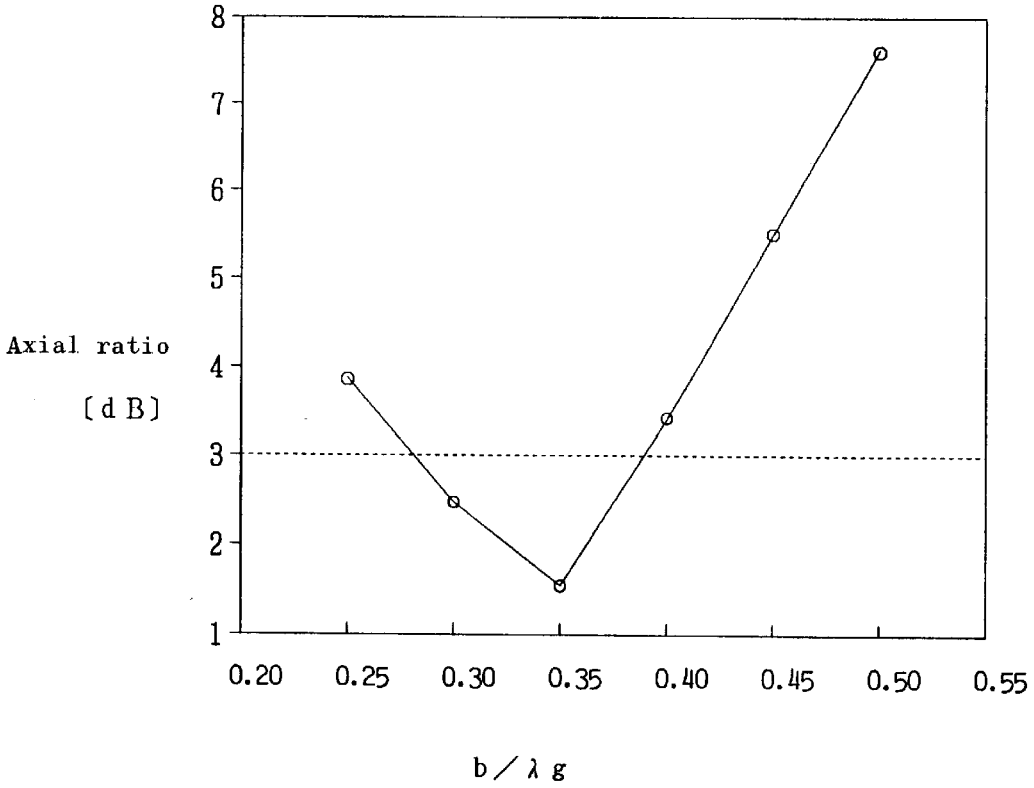
FIG. 17 is a graph of an experimental result by measuring the relationship between b/g and the axial ration of a circularly polarized wave.

Therefore, the applicant of the present invention has variously altered the value of b/g under the condition of 2*a*+*b*+*c*=2 g by using the circular polarization microstrip line antenna in FIGS. 1 and 2, and hence the axial ratio of the long axis to the short axis of the circularly polarized wave radiated from the antenna. The result is illustrated in FIG. 17. As illustrated in FIG. 17, at the time of approximate b/g=0.35, it is understood that the axial ratio becomes minimum at dB unit. The axial ratio of a so-called completely circularly polarized wave in which the length of the long axis coincides with that of the short axis is within 0 dB. According to this experiment, at the time of about b/g=0.35, the axial ratio exhibits about 1.5 dB, and it is understood that excellent characteristics are exhibited.

As described above, the length b of the lateral side 24 is decided to be about 0.35 times as large as the line wavelength g, and it is determined that the length 2*a* of the upper side 22 is set to about 0.90 times as large as the line wavelength g (i.e., a is about 0.45 times of the line wavelength g) and the length c of the bottom side 23 is to be about 0.40 times as large as the line wavelength g.

As described above, the dielectric constant of the board 1 can be regarded as being "1", $g \approx_0$. Accordingly, the above result can be represented by $a \approx 0.45_0$, $b \approx 0.35_0$, $c \approx 0.40_0$. However, since the dielectric constant of the board 1 cannot be entirely ignored, the a, b and c are represented by free space wavelength $_0$, $a=0.45\tau_0$, $b=0.35\tau_0$ and $c=0.40\tau_0$ by using a correction factor in which the dielectric constant of the board 1 is considered.

Figure 18A:
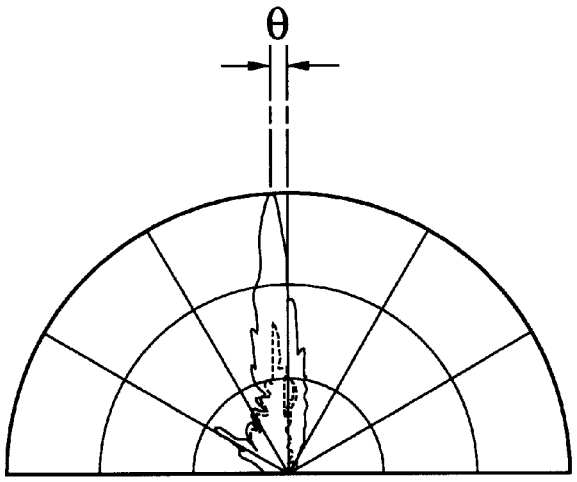
FIG. 18 is an explanatory view illustrating an experimental result of the directivity of a circular polarization microstrip line antenna wherein $a=0.45_0$, $b=0.35_0$, and $c=0.40_0$, and FIG. 18(*a*) illustrates the directivity of a right-handed circularly polarized wave, and FIG. 18(*b*) illustrates the directivity of a right-handed circularly polarized wave.
Figure 18B:
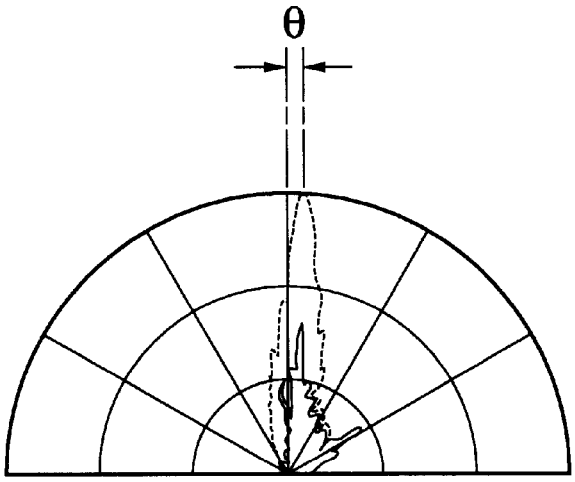

The applicant of the present invention has measured for both the case that the directivity is a left side power supply and a right side power supply by using a circular polarization microstrip line antenna in which first $a=0.45_0$, $b=0.35_0$, and $c=0.40_0$ to specify the value of the correction factor $\tau$. The result is illustrated in FIG. 18. FIG. 18(*a*) illustrates the case of the left side power supply, i.e., the directivity of the right-handed circularly polarized wave is inclined leftward at an angle $\theta$ (about 4 degrees), and in the case of the right side power supply, i.e., the directivity of the left-handed circularly polarized wave is inclined rightward at an angle $\theta$ (about 4 degrees). The angle of the traveling wave corresponding to the length (2*a*+*b*+*c*) of one peroid of the square wave shape according to the angle , in order to set it to 720 degrees, it is understood that the a, b and c may be multiplied by about 1.042 times. Accordingly, the value of the correction factor $\tau$ is $\tau=1.042\pm5\%$ (where ±5% is obtained by considering an error).

Figure 19A:
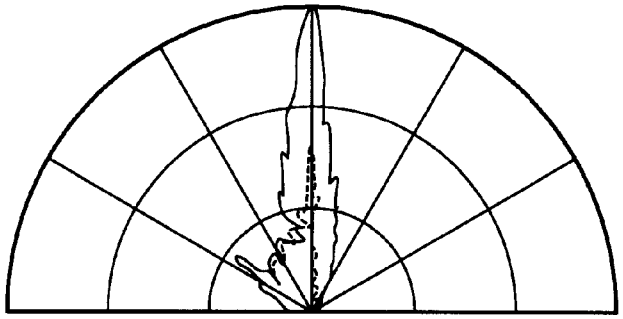
FIG. 19 is an explanatory view illustrating an experimental result of the directivity of a circular polarization microstrip line antenna, wherein $a=0.45\tau_0$, $b=0.35\tau_0$, $c=0.40\tau_0$ (where $\tau=1.042$), and FIG. 19(*a*) illustrates the directivity of a right-sided circularly polarized wave, and FIG. 19(*b*) illustrates the directivity of a left-sided circularly polarized wave.
Figure 19B:
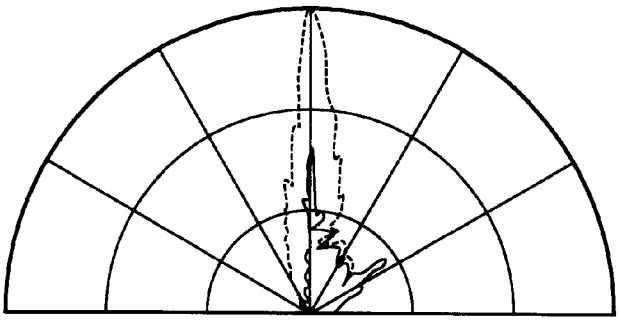

The applicant of the present invention has actually applied the value of the $\tau$ to the above-described formulae $a=0.45\tau_0$, $b=0.35\tau_0$ and $c=0.40\tau_0$ and again executes an experiment. The result is as illustrated in FIG. 19, the positional deviation is eliminated even in the right-handed circularly polarized wave by the left-side power supply (FIG. 19(*a*)) or the left-handed circularly polarized wave by the right-side power supply (FIG. 19(*b*)) as illustrated in FIG. 19.

Figure 20:
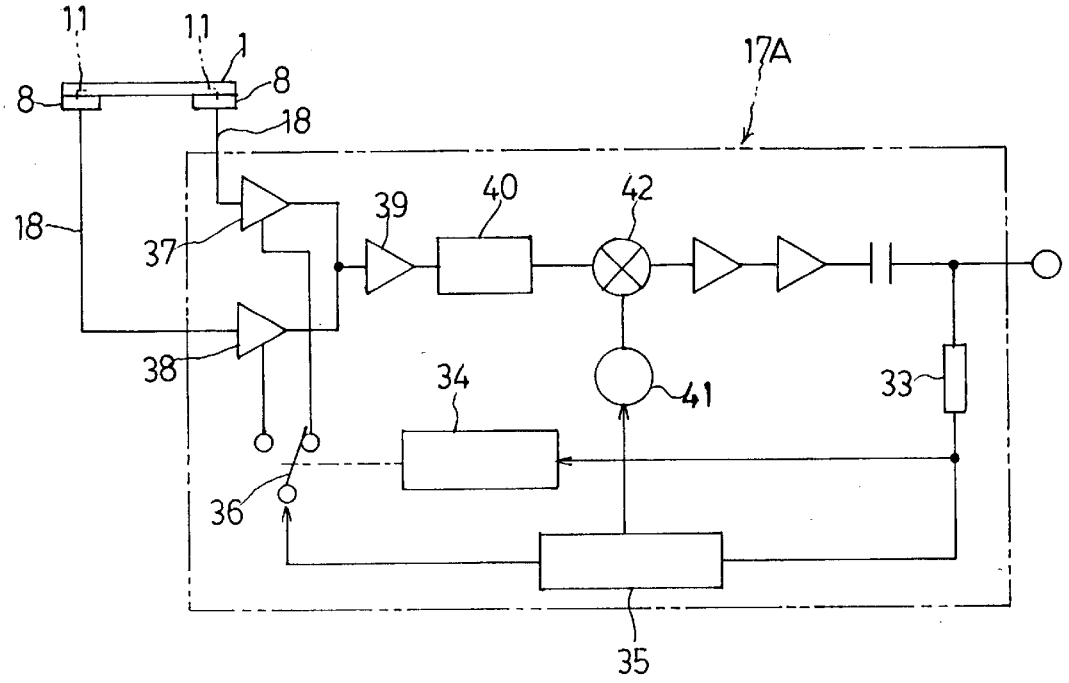
FIG. 20 is a circuit diagram illustrating still another embodiment of claim 11.

FIG. 20 illustrates a still another embodiment of the present invention of claim 11, a low noise converter (hereinafter referred to as "LNB") 17A is connected as the receiver 17 to a microstrip line antenna illustrated in FIGS. 1 and 2. The LNB 17A inputs high and low voltage signals of two types to a comparator 34 via a coil 33 by switching an external switch (not shown). If the comparator 34 receives the signal of the high voltage side, a switch 36 mounted at the output side of a power supply 35 is shifted to the right as illustrated in FIG. 20 to so operate as to apply the voltage of the power supply 35 to the emitter of an amplifier A37, and if the comparator 34 receives the signal of the low voltage side, the switch 36 is shifted to the left to apply the voltage of the power supply 35 to the emitter of an amplifier B38. Then, the base of the amplifier A38 is connected to a rectangular waveguide 8 disposed at the right side of the board 1 via a coaxial cable 18 of the right side, and the base of the amplifier B38 is connected to the rectangular waveguide 8 disposed at the left side of the board 1 via the coaxial able 18 of the left side.

Accordingly, the operator can arbitrarily select whether a feeding pin 11 disposed at the right side of the board 1 is set to a power supplying point or a feeding pin 11 disposed at the left side is set to a power supplying point by such switching operation.

In the case of the right side power supply, the left-handed circularly polarized wave of the circular polarized wave energy oscillated from a broadcasting satellite or a communication satellite is absorbed, and injected to the amplifier A37 via the right side rectangular waveguide 8 and the right side coaxial cable 18. On the other hand, in the case of the left side power supply, the right-handed circularly polarized wave of the ciruclarly polarized wave energy is absorbed to be injected to the amplifier B38 via the left side rectangular waveguide 8 and the left side coaxial cable 18. The signals are amplified by the amplifiers A37 and B38, and frequency-converted by an oscillator 41 and a mixer 42 via an amplifier 39 and a bandpass filter 40, and output via a predetermined circuit.

Figure 21:
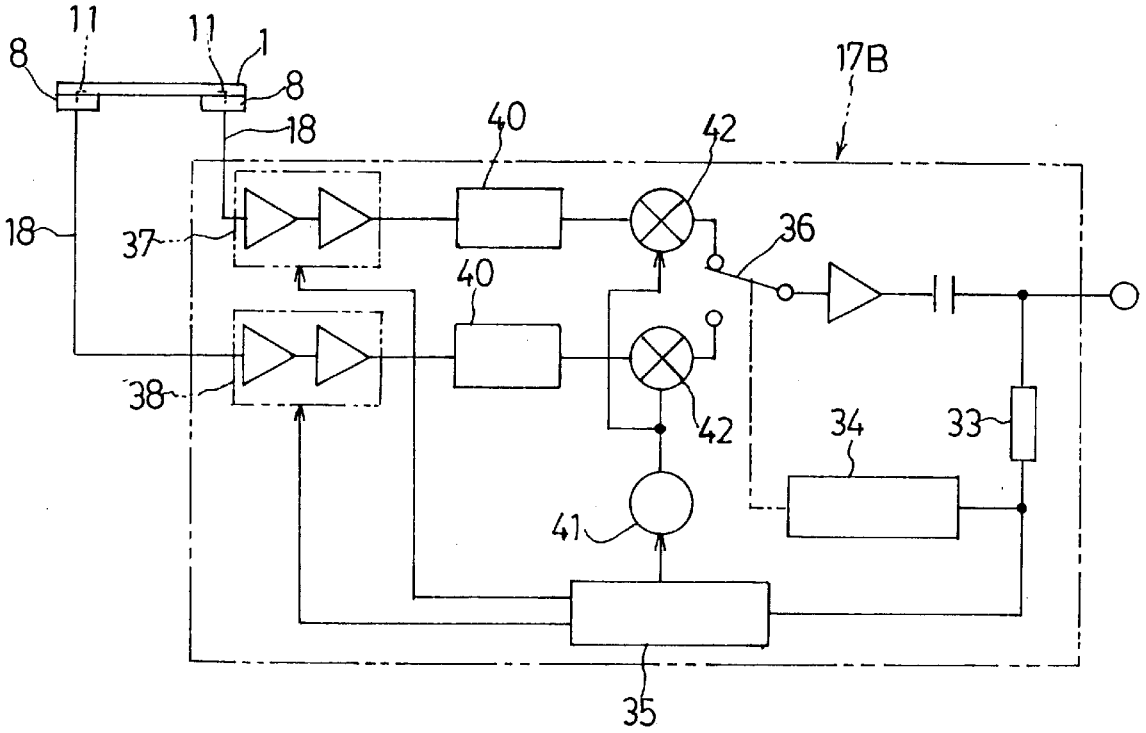
FIG. 21 is a circuit diagram illustrating still another embodiment of claim 11.

FIG. 21 illustrates an LNB 17B according to the still another embodiment of the present invention. The LNB 17B is different from the LNB 17A illustrated in FIG. 20 at the point of disposing a switch 36 at the rear of a mixer 42 (at the right side of FIG. 21). Two power supply outputs extended from a power supply 35 are directly connected to an amplifier A37 and an amplifeir B38 without switches, one band-pass filter 70 and a mixer 42 are connected to the amplifier A37, and another band-pass filter 40 and a mixer 42 are connected to the amplifier B38. The output of the oscillator 41 is branched and connected to the mixer 42 of the amplifier A37 and the mixer 42 of the amplifier B38. A comparator 34 shifts up or down the switch 36 in response to an external signal. Thus, when the siwtch 36 is shifted up, the right side power supply is executed to conduct the amplifier A37 and the band-pass filter 40 and the mixer 42 of the amplifier A37, and the left-handed circularly polarized wave can be received. On the other hand, when the swtich 36 is shifted down, the left side power supply is executed, and the amplifier B38 and the band-pass filter 40 and the mixer 42 of the amplifier B38 are conducted, and the right-handed circularly polarized wave can be received.

As described above, the operator can arbitrarily receive the left-handed circularly polarized wave or the right-handed circularly polarized wave by one receiver 17 loading one microstrip line antenna. When the period shape of the microstrip line 5 is altered to a linearly polarized wave reception, the linearly polarized wave can be received if any of the right and left power supplying points is selected. If the other is selected, the horizontally polarized wave can be received.

As described above, the embodiment of the present invention of the claim 1 is constituted to transmit and receive any of the left-handed and right-handed circularly polarized waves by one circular polarization microstrip line antenna by providing power supplies at both the right and left ends of the microstrip line. Therefore, it is not necessary to connect the microstrip line antennas of the left-handed and right-handed circularly polarized waves to the power supplies in combination, and can be reduced in size.

According to the embodiment of the present invention of claim 2, the end of the microstrip line is vertically opposed to the horizontal part of the power supply via the dielectric sheet by forming the power supply in an inverted L shape to electromagnetically couple the microstrip line to the power supply. Therefore, it is not necessary to solder the end of the power supply to the end of the microstrip line, thereby simplifying the connecting step of the circular polarization microstrip line antennal to the power supply.

The embodiments of the present invention of the claims 3 and 4 is constituted to bridge the feeding pin to be the power supply to the probe of the transmitter or receiver side via the waveguide. Therefore, the labor hour of connecting the coaxial cable one by one to the ends of the microstrip lines as the prior art is omitted, thereby simplifying the configuration of the power supply.

Further, the embodiment of the present invention of the claim 4 uses the parabola waveguide to constitute the transmission distances in the tube all for the feeding pins constant. Thus, since the phases and the amplitudes of all the feeding pins indispensably coincide, the degree of freedomes of the sizes of the feeding pins and the microstrip lines are increased, and design and assembly are facilitated. Further, when the parabola waveguide is used, the position of the probe of the transmitter and the recevier side can be approached to the vicinity of the center of the board for the right and left probes, and hence if the transmitter and the receiver are disposed at the center of the board, the probe can be connected directly to the transmitter and the receiver, which are not necessarily connected by the coaxial cable to simplify the configuration of the power supply, thereby enhancing the efficiency of the assembling work.

The embodiments of the present invention of the claims 5 and 6 open the slits at the waveguide, and both the right and left ends of the flexible film are inserted into the slits to bridge the end of the microstrip line patterned on the right and left end surfaces of the flexible film to the probes of the transmitter and the receiver via the waveguide. Therefore, the labor hour of connecting one by one the ends of the microstrip lines to the coaxial cable is omitted similarly to the embodiments of the invention of the claims 3 and 4 described above. Further, the embodiment of the invention of the claim 6 uses the parabola waveguide, and hence the degree of the freedoms of the size of the microstrip line is increased similarly to the embodiment of the invention of the claim 4, and the coaxial cable for connecting the probes to the transmitter and the receiver is not only eliminated but also it is not necessary to insert one by one the feeding pins to the holes of the waveguide in the embodiments of the invention of the claims 5 and 6, and hence the configuration of the power supply is further simplifierd to enhance the efficiency of the assembling work.

The embodiment of the invention of the claim 7 provides the partition plate in the cavity of the parabola waveguide of the embodiment of the invention of the claims 4 and 6 to propagate only the radio wave reflected by the parabolic surface to the end of the feeding pin or the microstrop line and the probes of the transmitter and the receiver side. Therefore, the noise generated by the direct wave is eliminated, thereby improving the antenna performance.

The embodiment of the invention of the claim 8 sets the lengths of the upper side, the lateral side and the bottom side for constituting the square wave shape of the microstrip line by about 0.90, 0.35 and 0.40 times as large as the line wavelength, and the embodiment of the invention of the claim 9 sets the lengths by about 0.90τ, about 0.35τ and about 0.40τ as large as the free space wavelength to remarkably approach the axial ratio to 0 dB to an ideal circularly polarized wave, thereby improving the directivity.

When the dielectric constant of the board is remarkably near "1" like the embodiment of the invention of the claim 10, the value of the τ is set to 1.042±5%, thereby obtaining the excellent directivity by completely eliminating the phase deviation.

As described above, even when both the right-handed and left-handed circularly polarized waves can be transmitted and received by one circular polarization microstrip line antenna, the antenna characteristics capable of being sufficiently satisfied can be performed.

The embodiment of the invention of the claim 11 provides the power supplies at both the right and left sides of the microstrip line and means for selecting any of the right and left power supplies as the power supplying point. Thus, both the right-handed and left-handed circularly polarized waves or the vertically and horizontally polarized waves can be received by one receiver loading the one microstrip line antenna. Thus, the functions of the receiver are increased by double, and the microstrip line antenna corresponding to the polarized waves is installed, and further it is not necessary to align the receiver at the microstrip line antenna to reduce in size as a whole, thereby contributing to the deletion in the expenses.

The embodiment of the invention of the claim 12 sets the lengths of the upper side, the lateral side and the bottom side for constituting the square wave shape in the receiver for the circularly polarized wave in which the microstrip line is formed in a square wave shape by about 0.90, 0.35 and 0.40 times of the line wavelength to remarkably improve the directivity of the antenna. Therefore, when the right-handed and left-handed circularly polarized waves transmitted from one satellite are received by one receiver, the azimuth of the antenna is matched by the one characteristic polarized wave, even if it is switched to the other characteristic polarized wave, no deviation of the angle occurs, and the merit of receiving the both characteristic polarized waves is not eliminated.

The present invention is in no way limited to the above-mentioned embodiments only but can be modified in a variety of ways within the technical scope of the invention.

We claim:

1. A circular polarization microstrip line antenna and power supply comprising a microstrip line bent to a predetermined period wave shape on a front surface of a board, a ground plane formed on a rear surface of the board, power supply units provided at both right and left ends of the microstrip line, wherein in the case of transmitting and receiving, one of the right and left power supply units is used as a power supplying point to transmit and receive right-handed and left-handed circularly polarized waves.

2. A circular polarization microstrip line antenna and power supply according to claim 1, further comprising at least one rectangular waveguide, wherein a hole is perforated at an upper surface of the rectangular waveguide, a feeding pin is suspend by a predetermined amount in a cavity of the rectangular waveguide via the hole, and a probe is projected to a predetermined position of a lower surface of the cavity of the rectangular waveguide.

3. A circular polarization microstrip line and power supply comprising a microstrip line bent to a predetermined period wave shape on a front surface of a board, a ground plane formed on a rear surface of the board, power supply units provided at both right and left ends of the microstrip line, wherein in the case of transmitting and receiving, one of the right and left power supply units is used as a power supplying point to transmit and receive right-handed and left-handed circularly polarized waves, wherein a dielectric sheet is laid on a metal plate, a flexible film is laid on the dielectric sheet, the microstrip line is formed on the surface of the flexible film to form the board, the power supply unit is formed in an inverted L shape, the horizontal part of the upper end of the power supply unit is interposed between the flexible film and the dielectric sheet, and the horizontal part and the ends of the microstrip line are opposed in parallel.

4. A circular polarization microstrip line antenna and power supply comprising a microstrip line bent to a predetermined period wave shape on a front surface of a board, a ground plane formed on a rear surface of the board, power supply units provided at both right and left ends of the microstrip line, wherein in the case of transmitting and receiving, one of the right and left power supply units is used as a power supplying point to transmit and receive right-handed and left-handed circularly polarized waves, further comprising parabola waveguides each having a parabolic surface of a parabolic shape as seen in plane at a peripheral side and a chordal surface for forming the chord of the parabola and oppositely arranged at both right and left sides, holes are perforated at the upper surface of the parabola waveguide and the vicinity of the chordal surface, feeding pins are suspended by a predetermined amount to the cavity of the parabola waveguide via the holes, and a probe is projected to the focus of the parabola at the lower surface of the cavity of the parabola waveguide.

5. A circular polarization microstrip line antenna and power supply comprising a microstrip line bent to a predetermined period wave shape on a front surface of a board, a ground plane formed on a rear surface of the board, power supply units provided at both right and left ends of the microstrip line, wherein in the case of transmitting and receiving, one of the right and left power supply units is used as a power supplying point to transmit and receive right-handed and left-handed circularly polarized waves, wherein a dielectric sheet is laid on a metal plate, a flexible film is laid on the dielectric sheet, a microstrip line is formed on the surface of the flexible film to form the board, rectangular waveguides are arranged under both right and left ends of the board, slits are perforated at the upper surface of the rectangular waveguide, both the right and left ends of the flexible film are bent down and inserted into the slits to suspend the ends of the microstrip line to the cavity of the rectangular waveguide and to project the probe to the predetermined position of the lower surface of the cavity of the rectangular waveguide.

6. A circular polarization microstrip line antenna and power supply comprising a microstrip line bent to a predetermined period wave shape on a front surface of a board, a ground plane formed on a rear surface of the board, power supply units provided at both right and left ends of the microstrip line, wherein in the case of transmitting and receiving, one of the right and left power supply units is used as a power supplying point to transmit and receive right-handed and left-handed circularly polarized waves, wherein a dielectric sheet is laid on a metal plate, a flexible film is laid on the dielectric sheet, a microstrip line is formed on the surface of the flexible film to form the board, right and left opposed parabola waveguides each having a parabolic surface of a parabolic shape as seen in plane at a peripheral side and a chordal surface for forming the chord of the parabola are arranged under the board, slits are perforated at the upper surface of the parabola waveguide and the vicinity the chordal surface, both the right and left ends of the flexible film are bent down to be inserted to the slits to suspend the end of the microstrip line by a predetermined amount to the cavity of the parabola waveguide, and the probe is projected to the focus of the parabola of the lower surface of the cavity of the parabola waveguide.

7. A circular polarization microstrip line antenna and power supply according to claim 4 or 6, wherein a partition plate fixed to the chord and separated at the peripheral edge by a predetermined amount from the parabolic surface is mounted in the cavity of the parabola waveguide.

8. A circular polarization microstrip line antenna comprising a microstrip line of a square wave shape formed on a front surface of a board, a ground plane formed on a rear surface of the board to transmit and receive a circularly polarized wave, wherein the lengths of an upper side, a lateral side and a bottom side for constituting the square wave shape are set to about 0.90, 0.35 and 0.40 times as large as the line wavelength.

9. A circular polarization microstrip line antenna comprising a microstrip line of a square wave shape formed on a front surface of a board, a ground plane formed on a rear surface of the board to transmit and receive a circularly polarized wave, wherein the lengths of an upper side, a lateral side and a bottom side for constituting the square wave shape are set to about $0.90\tau$, $0.35\tau$ and $0.40\tau$ (where $\tau$ is a correction factor) times as large as the free space wavelength.

10. A circular polarization microstrip line antenna according to claim 9, wherein when the dielectric constant of the board is remarkably near "1", the value of the $\tau$ is set to $1.042\pm5\%$.

11. A receiver loading a microstrip line antenna comprising a microstrip line of a predetermined period shape formed on a front surface of a board, a ground plane formed on a rear surface of the board to absorb a circularly polarized wave or a linearly polarized wave, wherein power supply units are provided at both right and left ends of the microstrip line, selecting means for setting one of both the right and left power supply units as a power supply point, thereby receiving the left-handed and right-handed circularly polarized waves or a vertical and horizontal linearly polarized.

12. A receiver according to claim 11 loading a microstrip line antenna, wherein the microstrip line is formed in a square wave shape, and the lengths of an upper side, a lateral side and a bottom side for constituting the square wave shape are set to about 0.90, 0.35 and 0.40 times as large as the line wavelength, thereby absorbing the circularly polarized waves.

* * * * *